US005591046A

United States Patent [19]

Klein et al.

[11] Patent Number: 5,591,046

[45] Date of Patent: Jan. 7, 1997

[54] ELECTRICAL CORD CLAMP

[75] Inventors: Lawrence J. Klein, Ansonia; Thomas R. J. Swift, Monroe, both of Conn.

[73] Assignee: Hubbell Incorporated, Orange, Conn.

[21] Appl. No.: 481,691

[22] Filed: Jun. 7, 1995

[51] Int. Cl.[6] ..... H01R 13/58

[52] U.S. Cl. ..... 439/467

[58] Field of Search ..... 439/467, 465, 439/466, 469, 460

[56] References Cited

U.S. PATENT DOCUMENTS

| | | | |
|---|---|---|---|
| 3,123,662 | 3/1964 | Fink | 439/467 |
| 3,393,395 | 7/1968 | Hubbell | 439/91 |
| 3,784,961 | 1/1974 | Gartland, Jr. | 439/107 |
| 3,856,376 | 12/1974 | Poliak et al. | 439/107 |
| 3,904,265 | 9/1975 | Hollyday et al. | 439/103 |
| 4,010,999 | 3/1977 | Hoffman | 439/467 |
| 4,080,036 | 3/1978 | Hagel | 439/103 |
| 4,108,527 | 8/1978 | Douty et al. | 439/107 |
| 4,138,185 | 2/1979 | Jaconette | 439/467 |
| 4,178,056 | 12/1979 | Lee | 439/103 |
| 4,208,085 | 6/1980 | Lawrence et al. | 439/103 |
| 4,213,667 | 7/1980 | Wittes | 439/103 |
| 4,561,715 | 12/1985 | Sanchez | 439/103 |
| 4,632,489 | 12/1986 | Skinner | 439/467 |
| 4,721,483 | 1/1988 | Dickie | 439/610 |
| 4,722,580 | 2/1988 | Kocher et al. | 439/466 |
| 4,749,369 | 6/1988 | Wang | 439/459 |
| 4,921,441 | 5/1990 | Sauder | 439/460 |
| 4,963,104 | 10/1990 | Dickie | 439/460 |
| 5,217,389 | 6/1993 | MacKay et al. | 439/466 |
| 5,277,619 | 1/1994 | Yamamoto | 439/469 |
| 5,304,075 | 4/1994 | Hoffman | 439/472 |

*Primary Examiner*—Gary F. Paumen
*Assistant Examiner*—T. C. Patel
*Attorney, Agent, or Firm*—Jerry M. Presson; David L. Tarnoff

[57] ABSTRACT

An electrical cord clamp is disclosed for securing an end of an electrical cord to an electrical device or connector. The electrical cord clamp provides strain relief between the ends of the electrical conductors of the electrical cord and the terminals of the electrical device or connector. The cord clamp has a pair of clamping members tiltably coupled to a pair of housing halves of the electrical device for tiltably engaging the electrical cord upon installation thereon to pull the electrical cord towards the terminals of the electrical device or connector. One or more spring elements are preferably provided for normally biasing the clamping members to their original position prior to assembly within the electrical device or connector. In one embodiment, the spring elements are integrally formed with the cover halves. In other embodiments, clamping members are provided with one or more spring elements or arms.

36 Claims, 19 Drawing Sheets

ELECTRICAL CORD CLAMP

FIELD OF THE INVENTION

This invention relates to an electrical cord clamp for securing an end of an electrical cord or cable to an electrical device or cord connector. More specifically, the present invention relates to an electrical cord clamp in combination with an electrical connector housing and a pair of inserts or clamping members for gripping the electrical cord to provide strain relief between the end of the electrical cord and the terminals of the electrical device or cord connector.

BACKGROUND OF THE INVENTION

Electrical devices such as electrical connectors typically have an electrical cord or cable extending outwardly from the device. It is necessary to securely fasten the electrical cord or cable to the electrical device or connector to prevent the electrical conductors from being pulled from their terminations, which can damage the conductors and the electrical device. If the electrical conductors are pulled or torn away from their terminations in the electrical device or connector, this can result in the electrical device or connector becoming inoperable, and in certain circumstances can result in serious injury to the user due to shorting of the electrical current being carried in the conductors.

Accordingly, corded electrical devices or connectors typically include a strain relief assembly for gripping and coupling the electrical cord or cable thereto, and for maintaining slack between the ends of the conductors and their respective terminals or electrical connections within the electrical device or connector. Presently, there are a wide variety of strain relief assemblies available for electrical devices or connectors. For example, many electrical devices or connectors have a pair of cord or cable clamping members for gripping and coupling the electrical cord thereto. Typically, one of the cord or cable clamping members is stationary, while the other cord or cable clamping member is movable in a direction substantially perpendicular to the longitudinal axis of the electrical cord. The clamping members may include a rib or a series of ribs for engaging the electrical cord to ensure a good grip on the electrical cord.

Examples of some prior electrical connectors having a strain relief assembly with a stationary clamp and a movable clamp are disclosed in the following U.S. Pat. Nos. 3,393,395 to Hubbell; 3,784,961 to Gartland, Jr.; 3,904,265 to Hollydale et al; 4,080,036 to Hagel; 4,178,056 to Lee; 4,213,667 to Wittes; 4,931,023 to Browne; 5,217,389 to MacKay et al; 5,304,075 to Hoffman; and 5,338,222 to Boteler.

However, these types of strain relief assemblies are often not suitable in certain circumstances and have certain drawbacks. For example, during clamping of the electrical cord, the installer must push the electrical cord towards the terminals and hold the electrical cord in this position, while at the same time tighten down the movable clamping member on the electrical cord. Moreover, some of these types of external clamps typically require a set of screws in addition to the screws for the electrical connector housing. Thus, this increases the costs of manufacturing such electrical connectors.

Examples of some other prior electrical connectors with internal strain relief are disclosed in the following U.S. Pat. Nos. 3,437,980 to Smith; 3,856,376 to Poliak et al; 4,108,527 to Douty et al; 4,138,185 to Jaconette, Jr.; 4,208,085 to Lawrence et al; 4,561,715 to Sanchez; 4,721,483 to Dickie; 4,722,580 to Kocher et al; 4,749,369 to Wang; 4,921,441 to Sauder; 4,963,104 to Dickie; and 5,277,619 to Yamamoto.

However, these types of strain relief assemblies also suffer certain disadvantages. For example, some of the strain relief assemblies increase difficulty of assembling the electrical connectors. Moreover, some of these strain relief assemblies are difficult to manufacture and require special molding procedures which can significantly increase the total cost of the electrical connectors.

In view of the above, it is apparent that there exists a need for an electrical cord clamp for an electrical device or connector which will overcome the above-mentioned problems of the prior art devices. This invention addresses this need in the art along with other needs which will become apparent to those skilled in the art once given this disclosure.

SUMMARY OF THE INVENTION

One object of the present invention is to provide an electrical device with a strain relief cord clamp which is relatively quick and easy to assemble about an electrical cord.

Another object of the present invention is to provide an electrical device with a cord clamp which axially pulls the end of an electrical cord being coupled thereto during assembly for providing strain relief between the ends of the electrical conductors and the terminals of the electrical device.

Still another object of the present invention is to provide a cord clamp for an electrical device which can be economically manufactured.

The foregoing objects are basically attained by an electrical wiring device adapted to be coupled to an end of an electrical cord with a plurality of conductors, comprising: a housing including first and second housing halves coupled together to form a cord receiving cavity therebetween, and a contact retainer body with terminals coupled therefor; and a cord clamp including a first clamping member tiltably coupled to the first housing half, and a second clamping member tiltably coupled to the second housing half, the first and second clamping members being positioned substantially opposite each other for tiltably engaging the electrical cord upon installation thereon to pull the electrical cord within said cord receiving cavity towards the terminals.

Other objects, advantages and salient features of the present invention will become apparent to those skilled in the art from the following detailed description, which taken in conjunction with the annexed drawings, discloses preferred embodiments of the present invention.

BRIEF DESCRIPTION OF THE DRAWINGS

Referring now to the drawings which form part of this original disclosure.

DETAILED DESCRIPTION OF THE PREFERRED EMBODIMENTS

Referring initially to FIGS. 1–4, an electrical wiring device or connector 10 with a strain relief arrangement is illustrated in accordance with a first embodiment of the present invention. While electrical device 10 is illustrated as a plug or a male electrical connector attached to one end of electrical cord 12, it will be apparent to those skilled in the art from this disclosure that electrical device 10 can be a female electrical connector as well as an electrical wiring device which in turn can be part of another device such as an appliance or tool.

Figure 1:
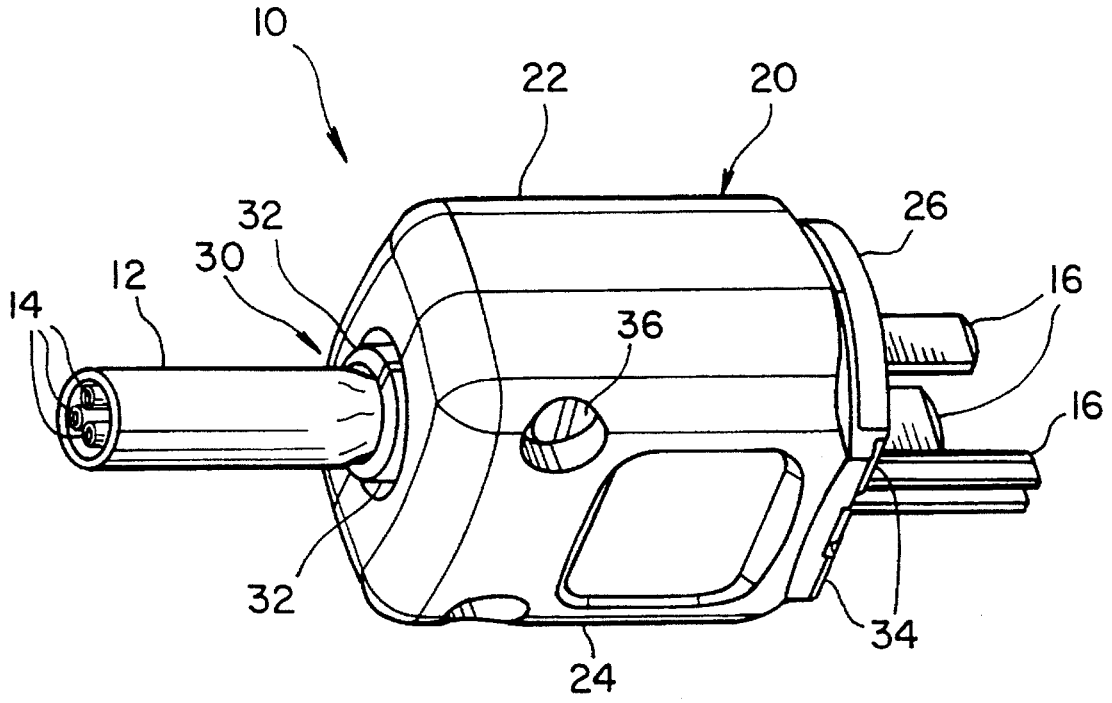
FIG. 1 is a rear end perspective view of an electrical wiring device in the form of a male electrical connector or plug coupled to an electrical cord in accordance with a first embodiment of the present invention.
Figure 2:
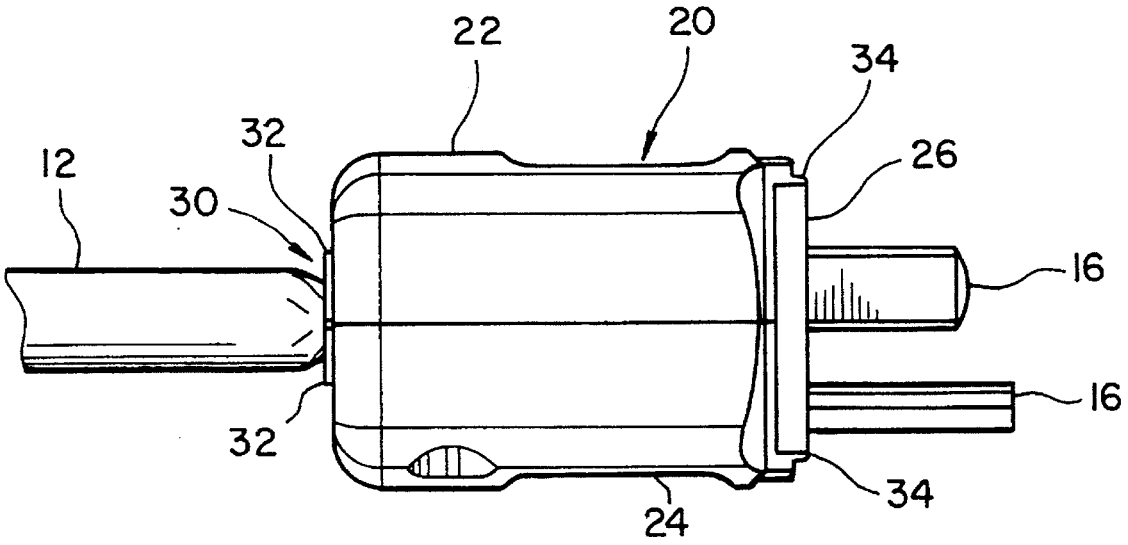
FIG. 2 is a side elevational view of the electrical connector illustrated in FIG. 1.

As seen in FIG. 1, electrical cord 12 is a conventional electrical cord, and thus, will not be discussed in detail. By way of example, electrical cord 12, as seen in the drawings, preferably has three electrical conductors 14 which have a conducting core and an insulating sheath thereon. The ends of the electrical conductors 14 are stripped for attaching to three electrical contacts or terminals 16 of electrical connector 10. While three conductors 14 are illustrated, it will be apparent to those skilled in the art that the present invention can be utilized with an electrical cord with two electrical conductors or with an electrical cord more than three electrical conductors. Of course, housing 20 would have to be modified to accommodate the additional conductor or conductors.

Figure 3:
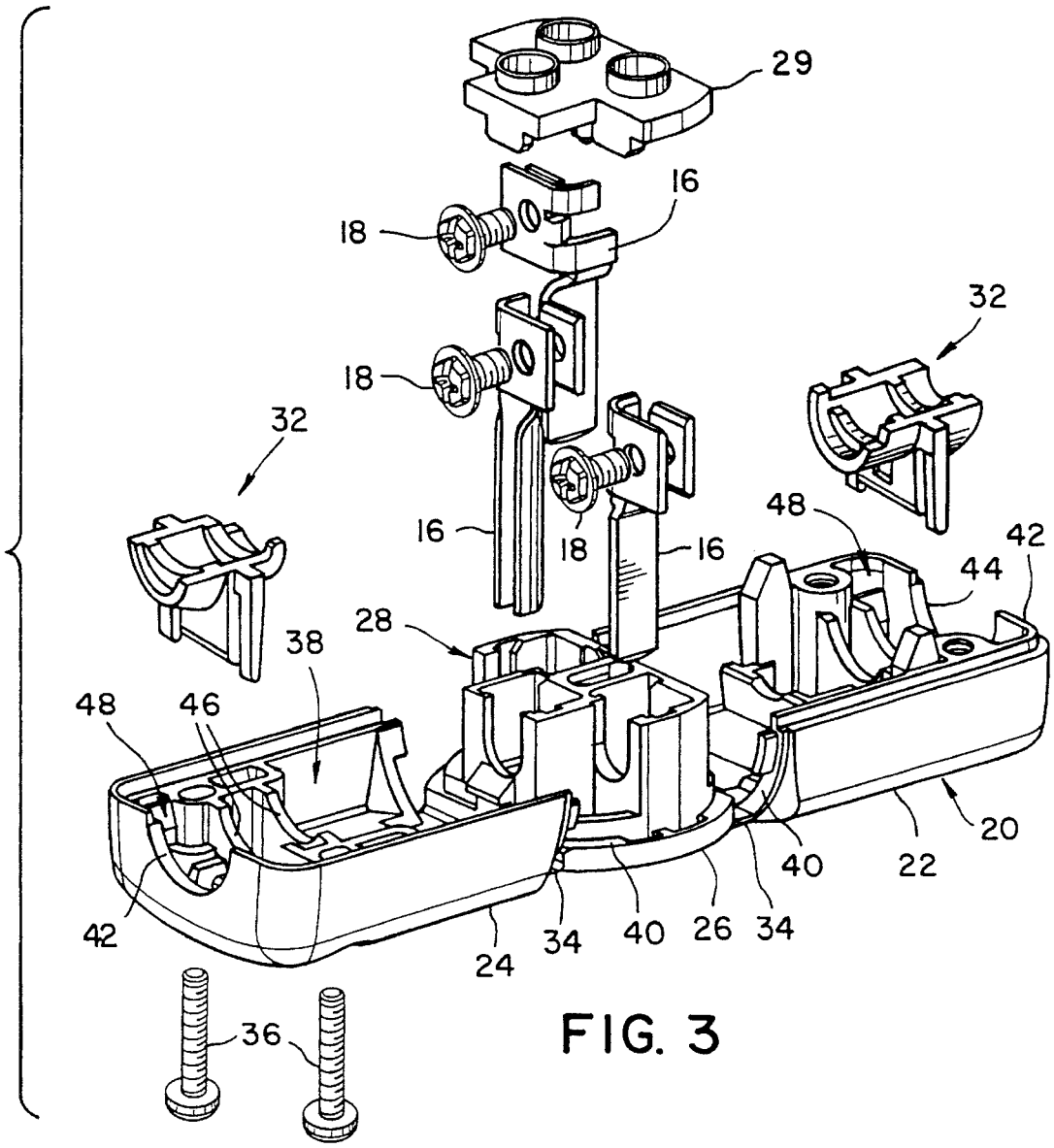
FIG. 3 is an exploded perspective view of the electrical connector and the electrical cord clamp illustrated in FIGS. 1 and 2.

As seen in FIG. 3, terminals 16 are preferably conventional male blade contacts with screws 18 for securing the stripped end of electrical conductors 14 thereto. Accordingly, terminals 16 will not be discussed or illustrated in detail herein.

Figure 4:
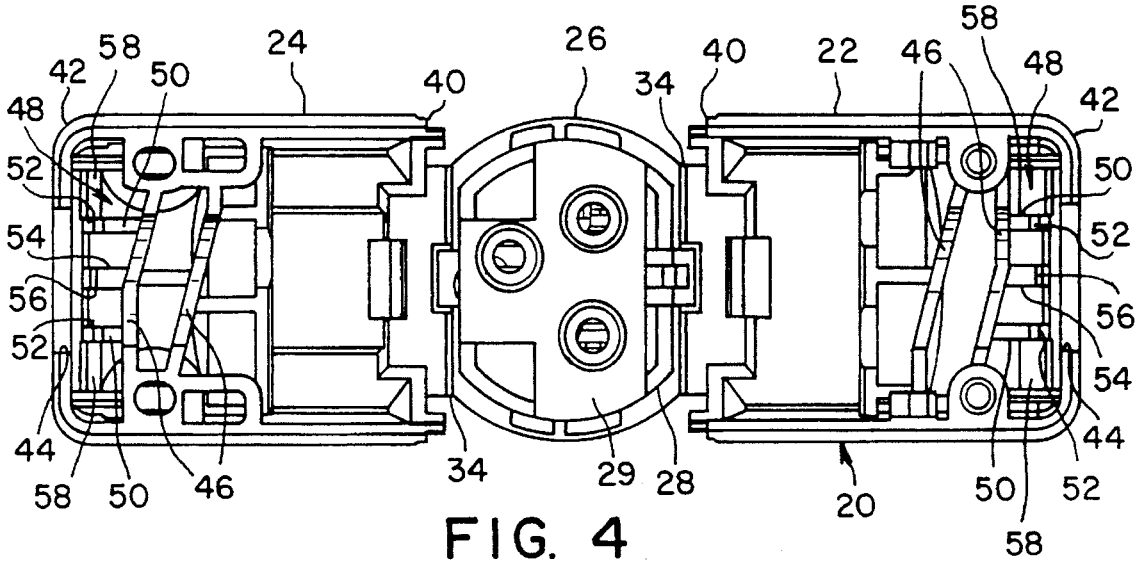
FIG. 4 is a top plan view of the electrical housing for the electrical connector illustrated in FIGS. 1–3 in its open condition and with the funnel cap and terminals coupled thereto.

As seen in FIGS. 3 and 4, electrical connector 10 has a housing 20 with a first cover half 22, a second cover half 24, a front cover face 26 and a contact retainer body 28. Electrical connector 10 also has a cord clamp 30 movably coupled within housing 20. Cord clamp 30 includes a pair of clamping members 32 which are designed to provide strain relief between the end electrical cord 12 coupled to electrical connector 10 and terminals 16. More specifically, clamping members 32 of cord clamp 30 engage electrical cord 12 during assembly of electrical connector 10 to axially pull electrical cord 12 towards terminals 16 of electrical connector 10. Clamping members 32 are explained in more detail below Electrical connector housing 20 is a modified version of the electrical connector housings illustrated and disclosed in U.S. Pat. No. 4,010,999 to Hoffman and U.S. Pat. No. 4,138,185 to Jaconette, Jr. The disclosure of these two U.S. patents are hereby incorporated herein by reference. Accordingly, electrical connector housing 20 will only be discussed herein as necessary to understand the present invention.

Preferably, first cover half 22, second cover half 24 and front cover face 26 along with contact retainer body 28 are all integrally formed as a one-piece, integral unit of a suitable insulating material such as nylon. More specifically, first cover half 22 and second cover half 24 are hinged to front cover face 26 by web hinges 34, while contact retainer body 28 is integrally formed with front cover face 26 and extends from the interior surface of front cover face 26 between cover halves 22 and 24.

As seen in FIGS. 1 and 3, electrical connector housing 20 is held in its assembled position by a pair of screws 36. Of course, other types of fastening members can be used to hold cover halves 22 and 24 together. For example, U.S. Pat. Nos. 4,108,527 to Douty et al and 5,217,389 to MacKay et al disclose cover halves coupled together using fasteners other than screws which could be utilized to interconnect first cover half 22 and second cover half 24 together.

Cover halves 22 and 24 are substantially identical for purposes of discussion of this invention. Of course, as seen in the Figures, there are some minor differences between cover halves 22 and 24 for mating of cover halves 22 and 24 together during assembly thereof. Accordingly, like reference numerals will be utilized to discuss the parts which are common between cover halves 22 and 24.

As seen in FIGS. 3 and 4, cover halves 22 and 24 form a cord receiving cavity 38 for receiving cord clamp 30, electrical cord 12 and contact retainer body 28 therein. More specifically, each of the cover halves 22 and 24 have an open end 40 coupled to front cover face 26 by web hinges 34, and a closed end 42 with a semi-circular cord opening 44. Each of the cover halves 22 and 24 further includes a pair of ribs 46 adjacent cord opening 44 for clamping electrical cord 12 when cord clamp 30 is not utilized.

Figure 5:
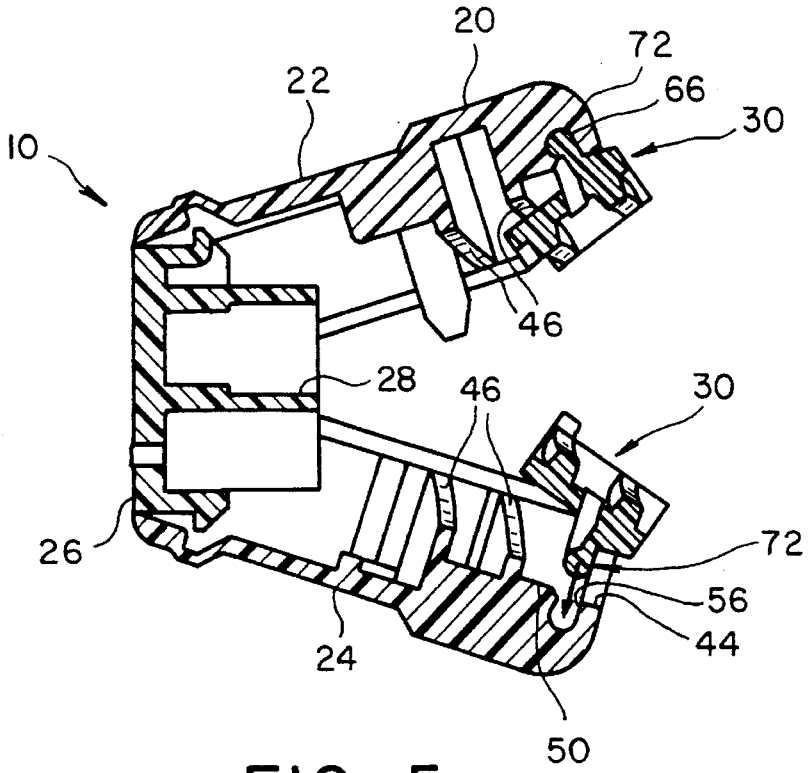
FIG. 5 is a partial cross-sectional view of the electrical connector housing and one of the clamping members illustrated in FIGS. 1–4.
Figure 6:
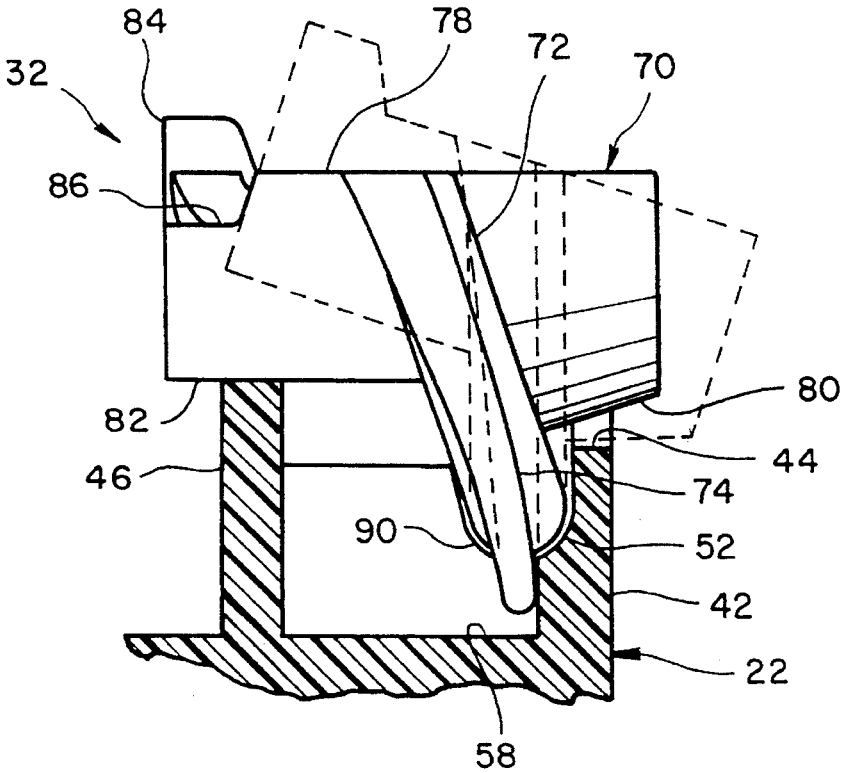
FIG. 6 is a side elevational view of one of the clamping members and partial cross-sectional view of the electrical connector housing of FIGS. 1–5, graphically and diagrammatically illustrating movement of the clamping member.
Figure 7:
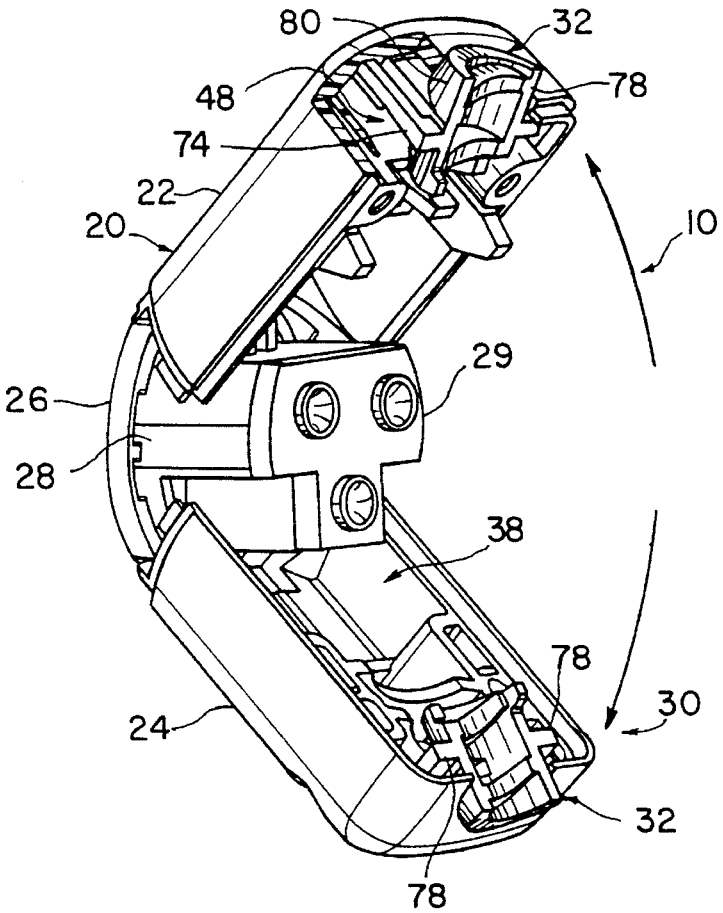
FIG. 7 is a rear end perspective view of the electrical connector illustrated in FIGS. 1–3 with its housing partially opened and a portion of the housing broken away for clarity.
Figure 8:
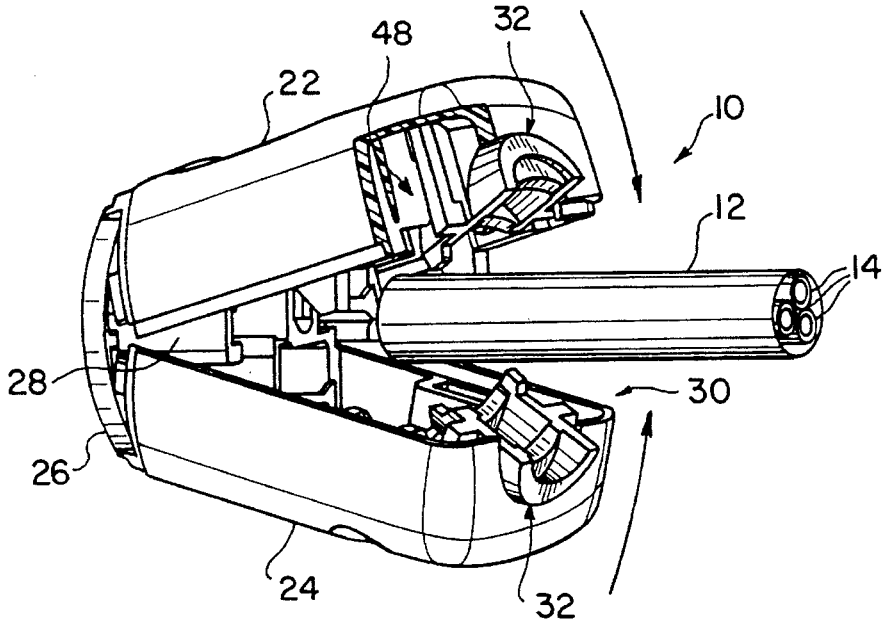
FIG. 8 is a rear end perspective view of the electrical connector similar to FIG. 7, but with an electrical cord coupled to its terminals and the housing pivoted closer together.
Figure 9:
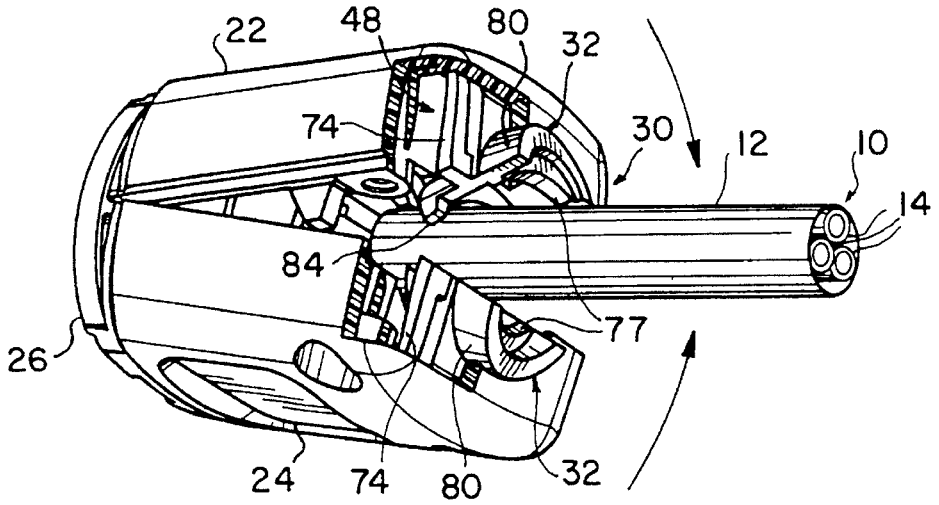
FIG. 9 is a rear end perspective view of the electrical connector similar to FIGS. 7 and 8, but with the housing pivoted closer together so that the clamping members contact the electrical cord.
Figure 10:
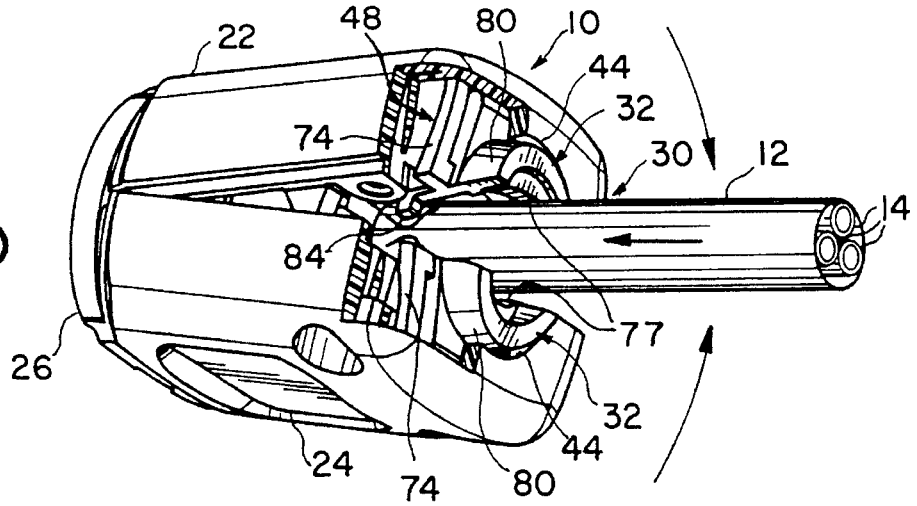
FIG. 10 is a rear end perspective view of the electrical connector similar to FIGS. 7–9, but with the housing pivoted such that the clamping members begin to tilt against the force of the spring arms and begin to axially pull the electrical cord.
Figure 11:
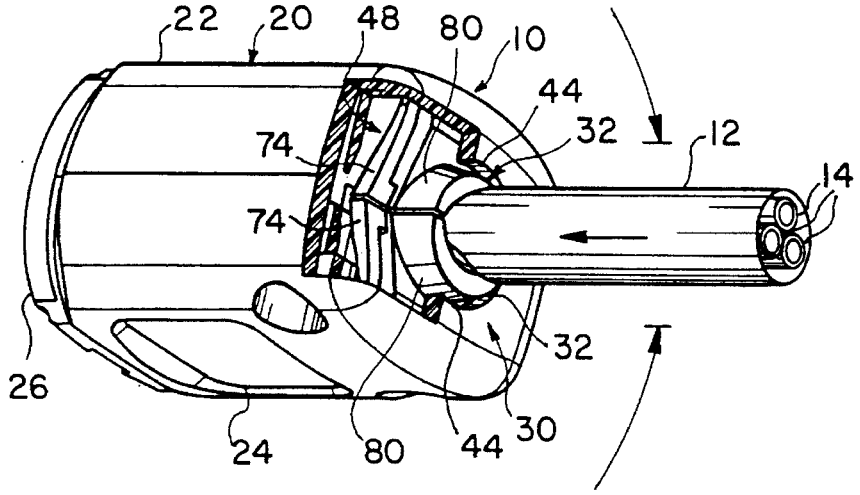
FIG. 11 is a rear end perspective view of the electrical connector similar to FIGS. 7–10, but with the housing completely pivoted to its closed position about the end of the electrical cord.
Figure 12:
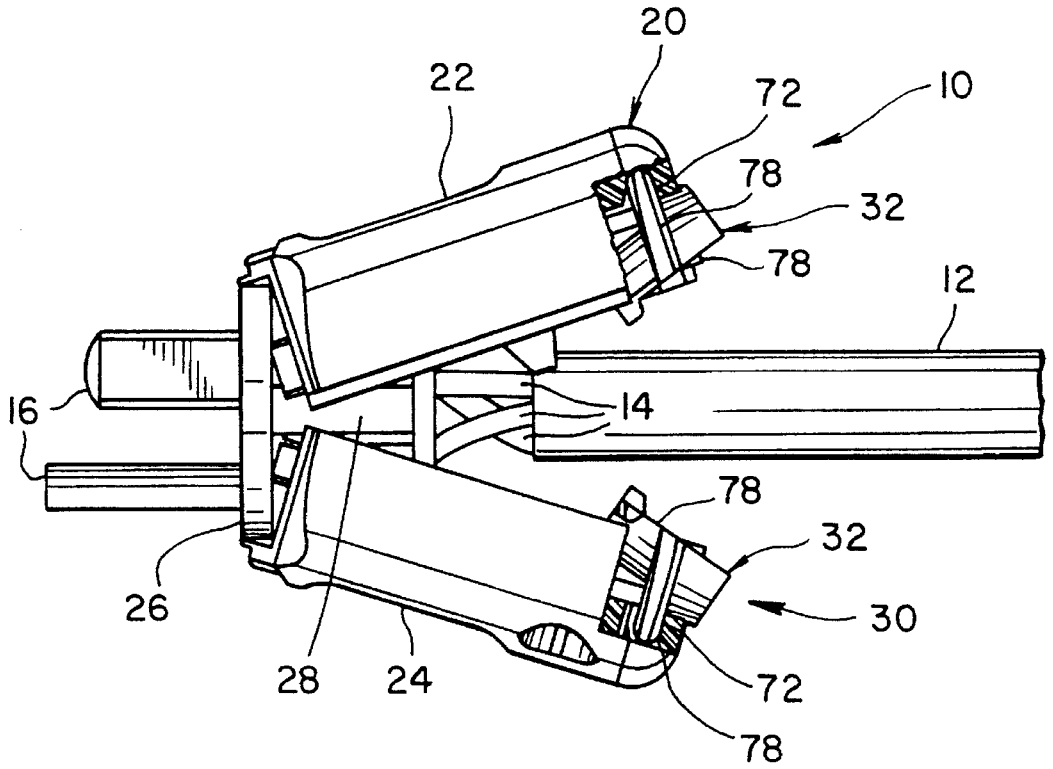
FIG. 12 is a side elevational view of the electrical connector illustrated in FIGS. 1–11 with an electrical cord about to be installed therein.
Figure 13:
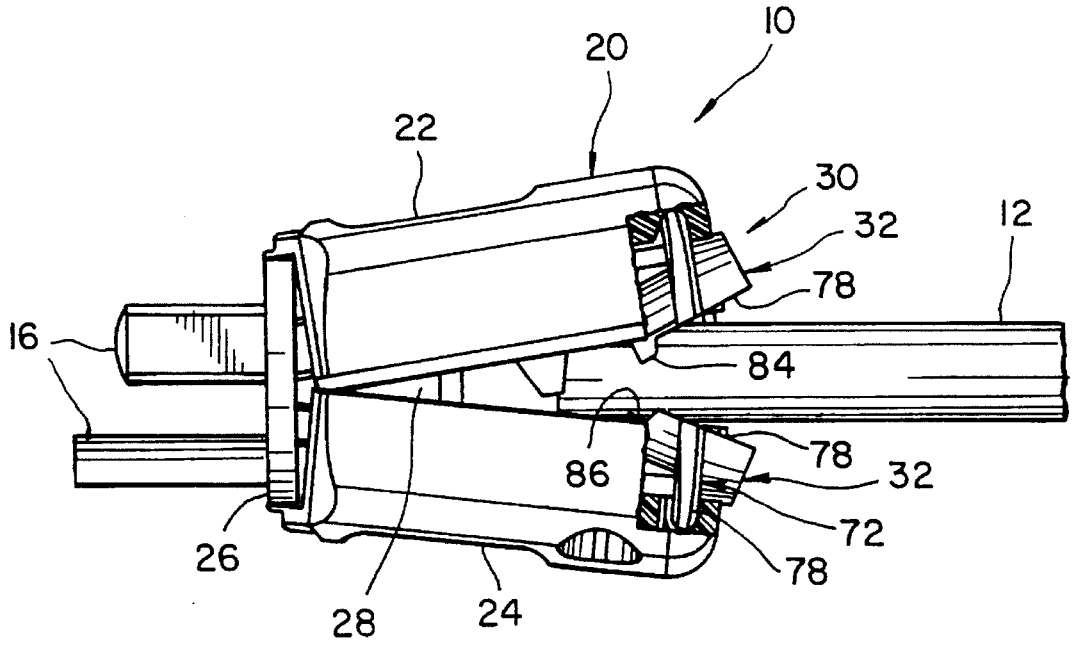
FIG. 13 is a side elevational view of the electrical connector illustrated in FIG. 12, but with the housing partially assembled on the electrical cord and the clamping members initially engaging the electrical cord.
Figure 14:
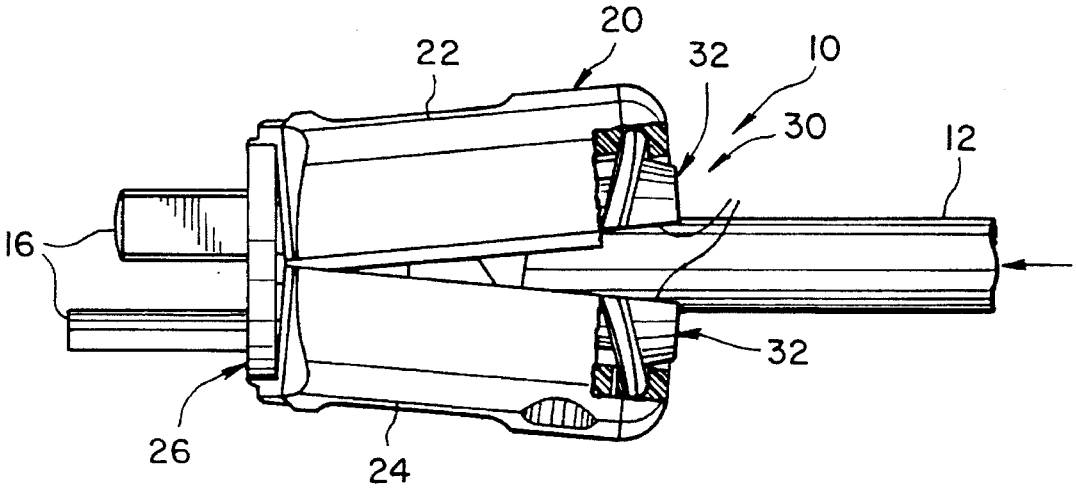
FIG. 14 is a side elevational view of the electrical connector illustrated in FIGS. 12 and 13, but with the housing partially assembled on the electrical cord and the clamping members gripping and pulling the electrical cord.
Figure 15:
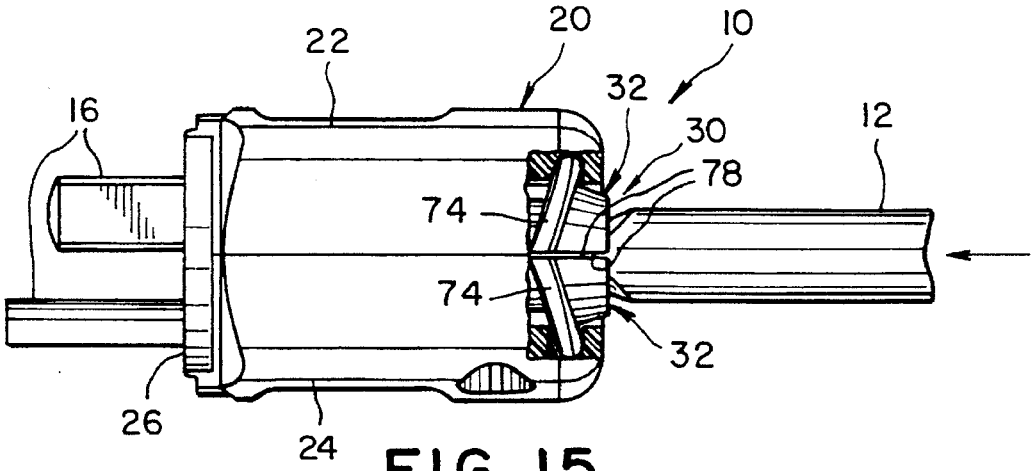
FIG. 15 is a side elevational view of the electrical connector illustrated in FIGS. 12–14, but with the housing fully assembled on the electrical cord and the clamping members fully tilted and clamped about the electrical cord.
Figure 16:
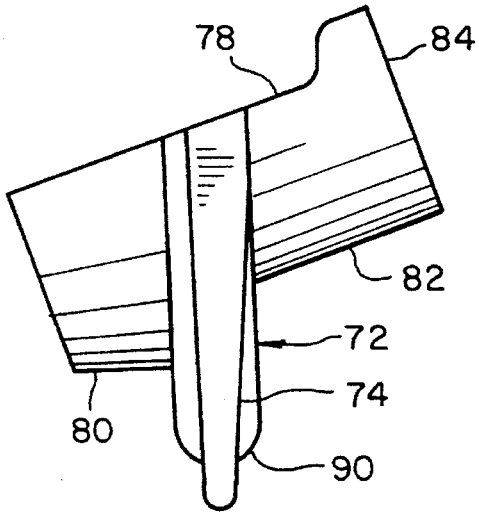
FIG. 16 is a left side elevational view of one of the clamping members for the cord clamp of the electrical connector illustrated in FIGS. 1–15.
Figure 17:
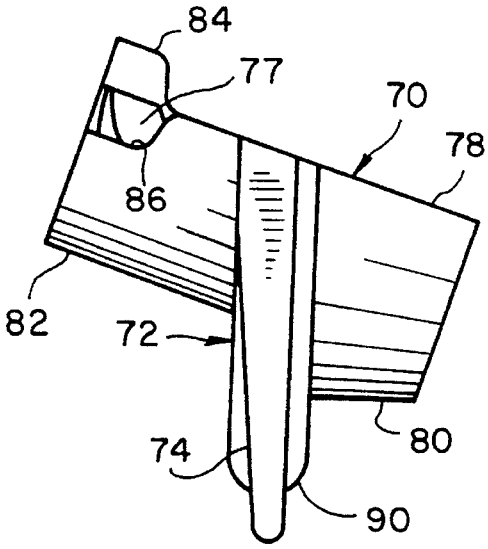
FIG. 17 is a right side elevational view of the clamping member illustrated in FIG. 16 for the cord clamp of the electrical connector illustrated in FIGS. 1–15.
Figure 18:
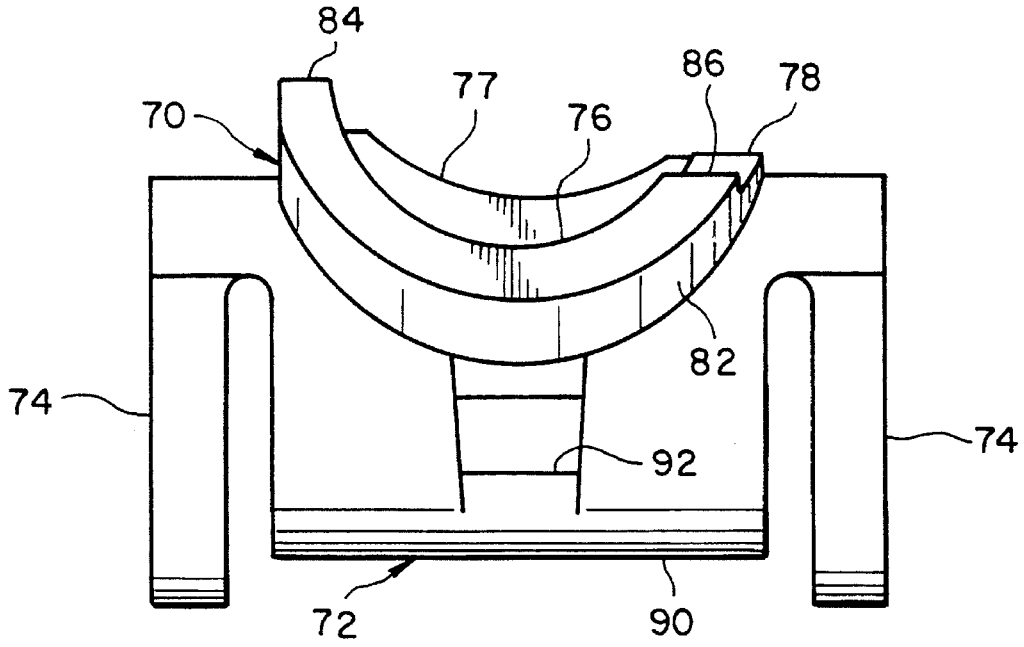
FIG. 18 is a first end elevational view of the clamping member illustrated in FIGS. 16 and 17 for the cord clamp of the electrical connector illustrated in FIGS. 1–15.
Figure 19:
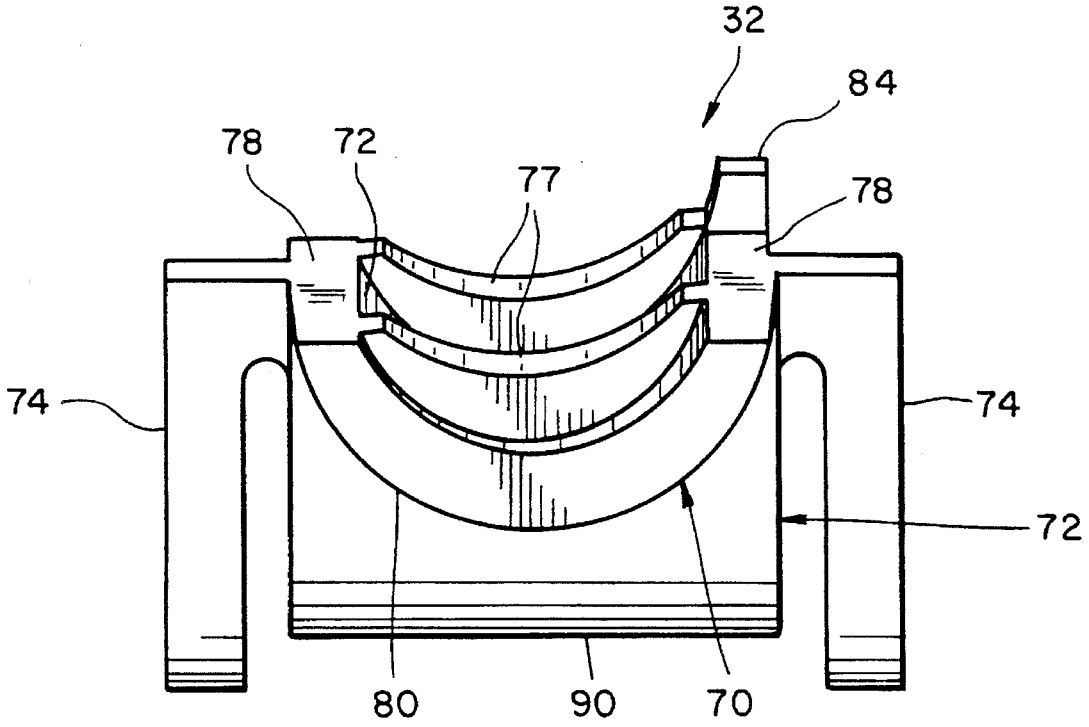
FIG. 19 is a second end elevational view of the clamping member illustrated in FIGS. 16–18 for the cord clamp of the electrical connector illustrated in FIGS. 1–15.
Figure 20:
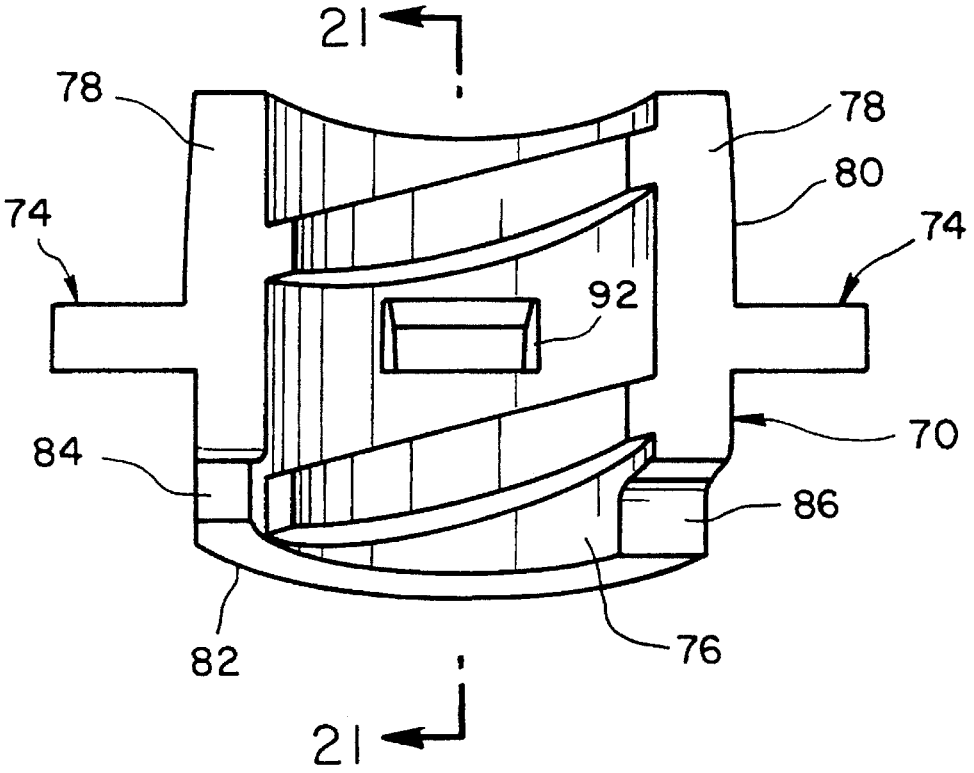
FIG. 20 is a top plan view of the clamping member illustrated in FIGS. 16–19 for the cord clamp of the electrical connector illustrated in FIGS. 1–15.
Figure 21:
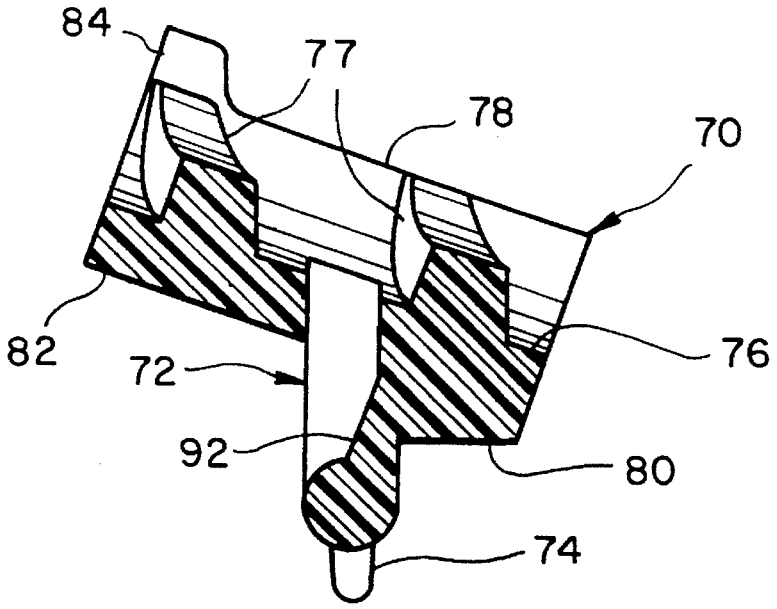
FIG. 21 is a cross-sectional view of the clamping member illustrated in FIGS. 16–20 taken along section line 21—21 of FIG. 20.
Figure 22:
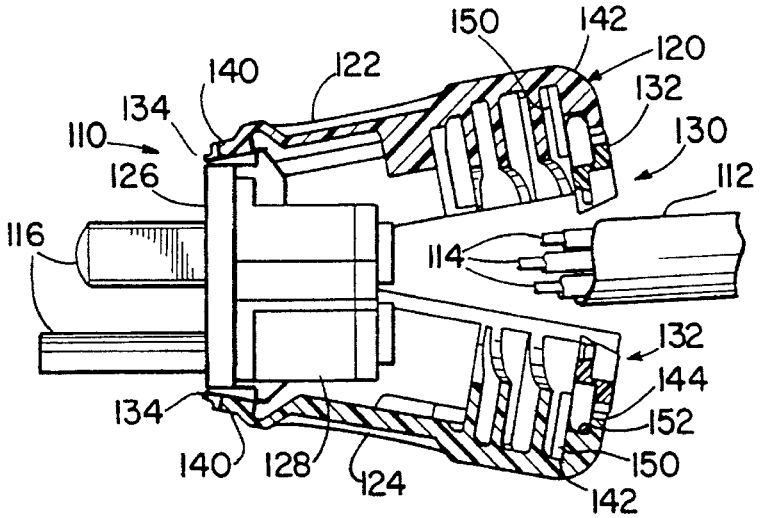
FIG. 22 is a partial longitudinal cross-sectional view of an electrical connector with an electrical cord clamp in accordance with a second embodiment of the present invention, which is about to be installed on the end of an electrical cord.
Figure 23:
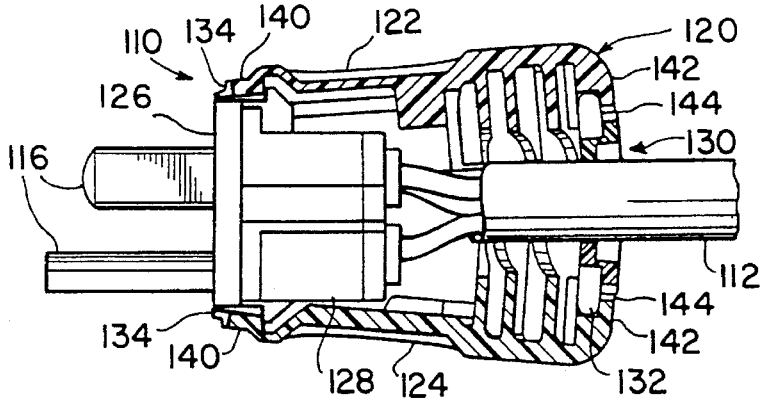
FIG. 23 is a partial longitudinal cross-sectional view of the electrical connector illustrated in FIG. 22 with the housing partially closed so that the clamping members engage the electrical cord.
Figure 24:
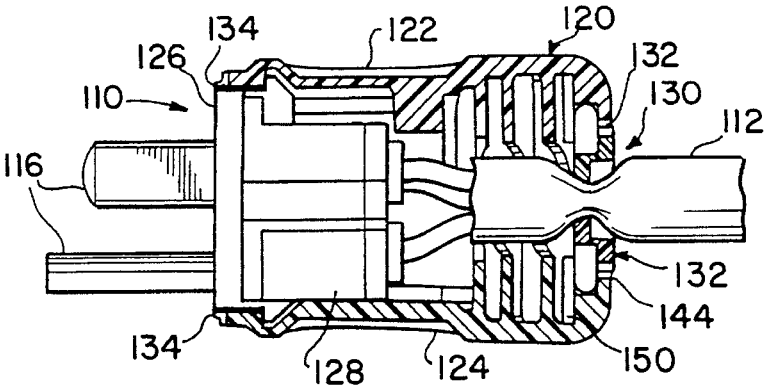
FIG. 24 is a partial longitudinal cross-sectional view of the electrical connector illustrated in FIGS. 22 and 23 with the housing almost fully closed so that the tilting surface of the clamping members are just touching.
Figure 25:
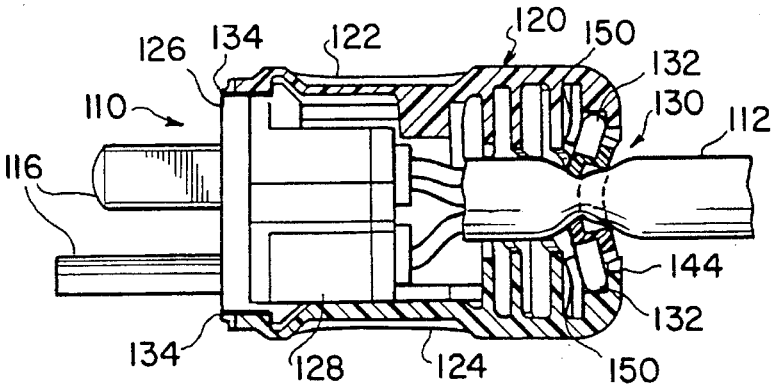
FIG. 25 is a partial longitudinal cross-sectional view of the electrical connector illustrated in FIGS. 22–24 with the housing fully closed so that the electrical cord is axially pulled further within the housing.
Figure 26:
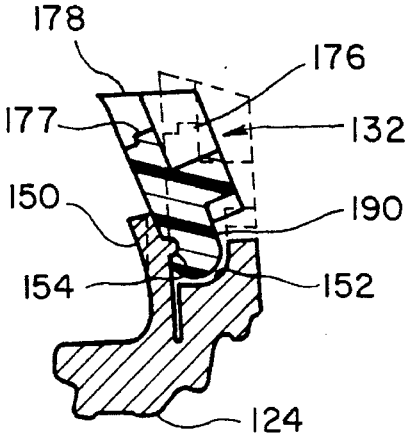
FIG. 26 is a partial cross-sectional view of one of the clamping members and part of the electrical connector housing of FIGS. 22–25, graphically and diagrammatically illustrating movement of the clamping member.
Figure 27:
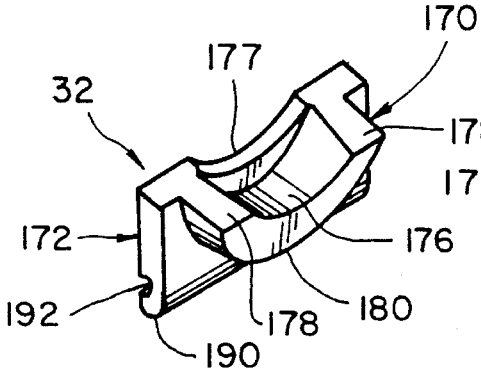
FIG. 27 is a perspective view of one of the clamping members for the cord clamp of the electrical connector illustrated in FIGS. 22–25.
Figure 28:
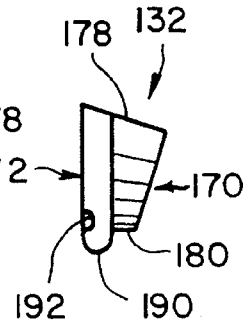
FIG. 28 is a side elevational view of the clamping member illustrated in FIG. 27 for the cord clamp of the electrical connector illustrated in FIGS. 22–25.
Figure 29:
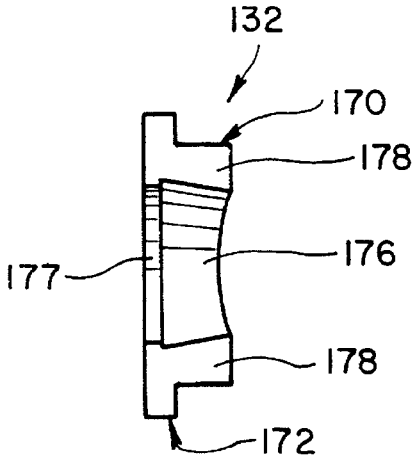
FIG. 29 is a top plan view of the clamping member illustrated in FIGS. 27 and 28 for the cord clamp of the electrical connector illustrated in FIGS. 22–25.
Figure 30:
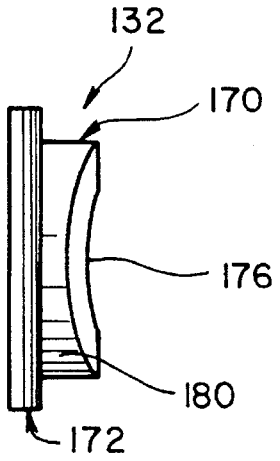
FIG. 30 is a bottom plan view of the clamping member illustrated in FIGS. 27–29 for the cord clamp of the electrical connector illustrated in FIGS. 22–25.
Figure 31:
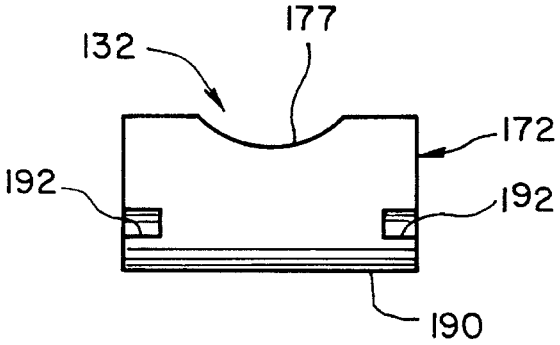
FIG. 31 is a first end elevational view of the clamping member illustrated in FIGS. 27–30 for the cord clamp of the electrical connector illustrated in FIGS. 22–25.
Figure 32:
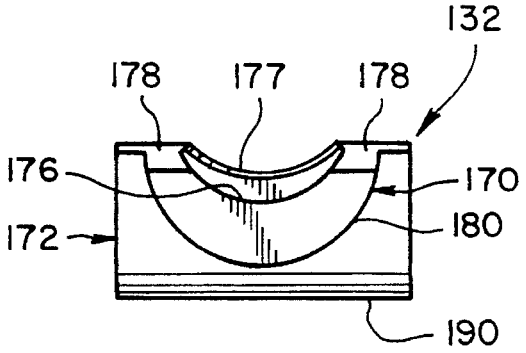
FIG. 32 is a second end elevational view of the clamping member illustrated in FIGS. 27–31 for the cord clamp of the electrical connector illustrated in FIGS. 22–25.
Figure 33:
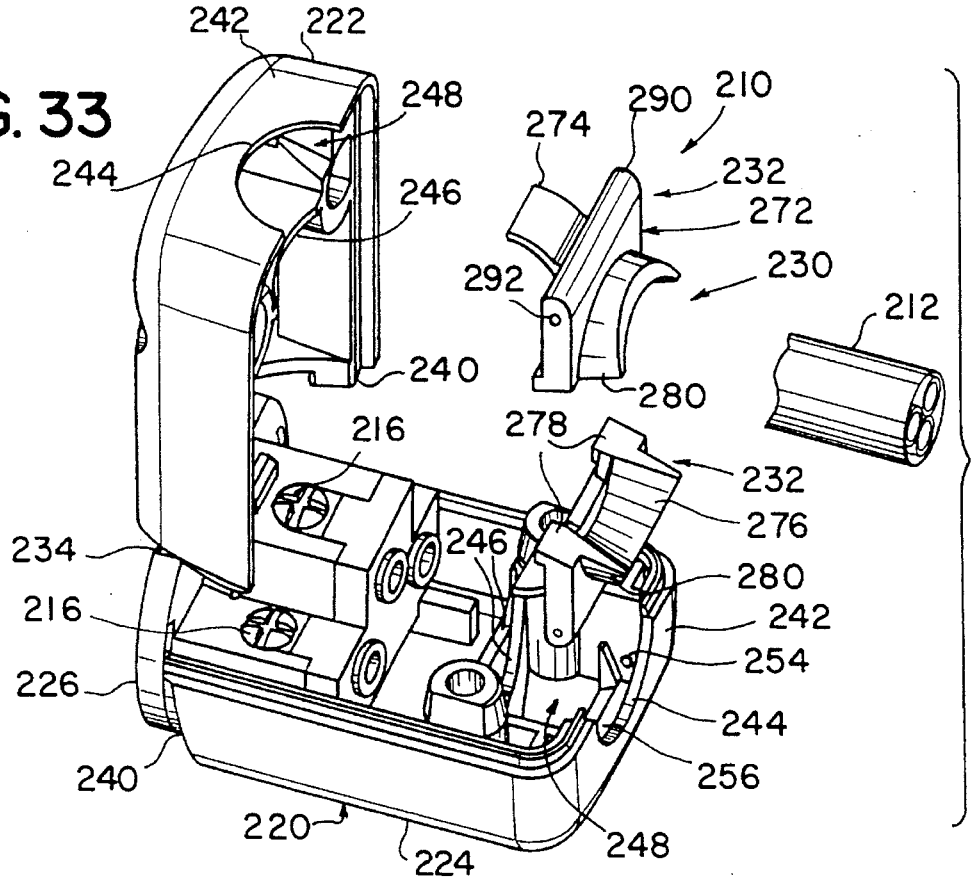
FIG. 33 is an exploded perspective view of an electrical connector and an electrical cord clamp in accordance with a third embodiment of the present invention.
Figure 34:
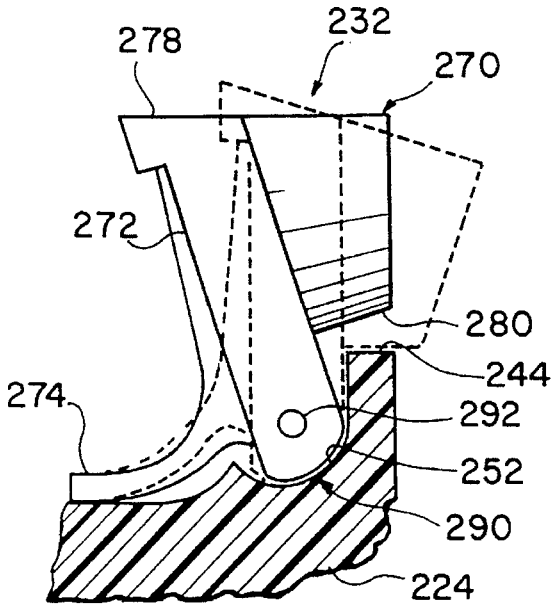
FIG. 34 is a partial cross-sectional view of one of the clamping members and part of the electrical connector housing of FIG. 33, graphically and diagrammatically illustrating movement of the clamping member.
Figure 35:
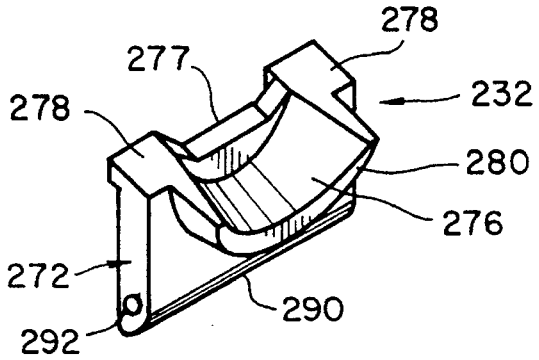
FIG. 35 is a perspective view of one of the clamping members for the electrical connector illustrated in FIG. 33.
Figure 36:
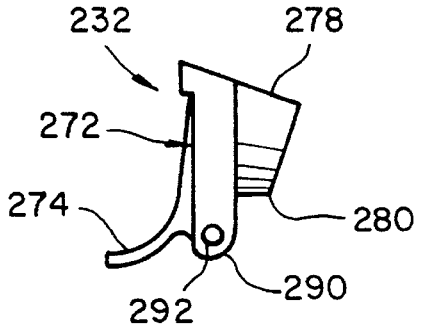
FIG. 36 is a side elevational view of the clamping member illustrated in FIG. 35 for the cord clamp of the electrical connector illustrated in FIG. 33.
Figure 37:
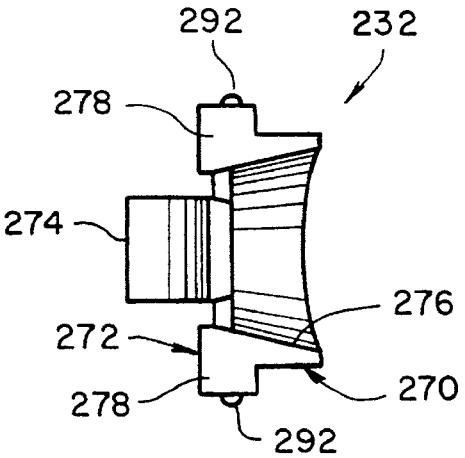
FIG. 37 is a top plan view of the clamping member illustrated in FIGS. 35 and 36 for the cord clamp of the electrical connector illustrated in FIG. 33.
Figure 38:
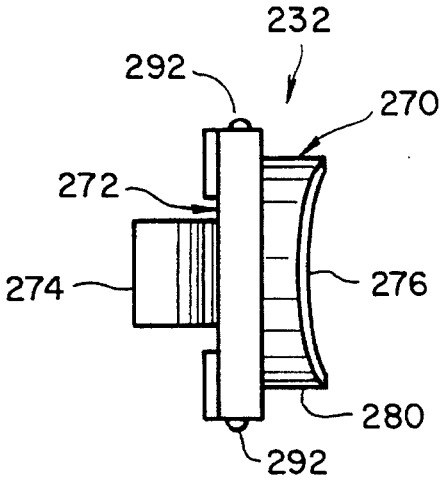
FIG. 38 is a bottom plan view of the clamping member illustrated in FIGS. 35–37 for the cord clamp of the electrical connector illustrated in FIG. 33.
Figure 39:
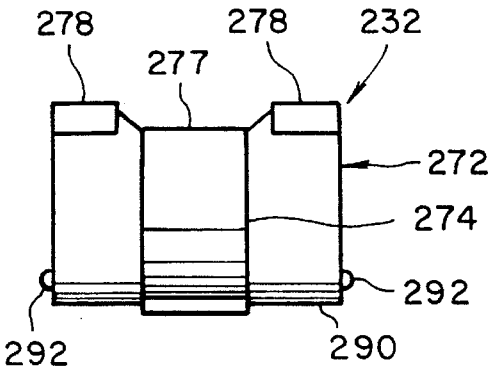
FIG. 39 is a first end elevational view of the clamping member illustrated in FIGS. 35–38 for the cord clamp of the electrical connector illustrated in FIG. 33.
Figure 40:
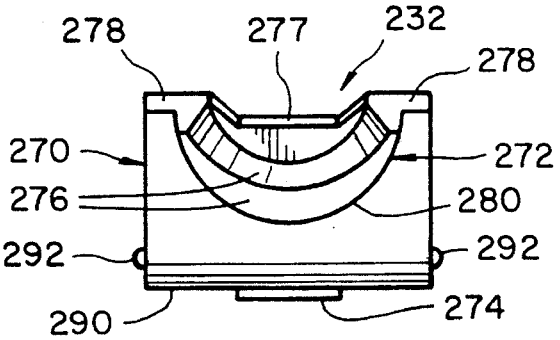
FIG. 40 is a second end elevational view of the clamping member illustrated in FIGS. 35–39 for the cord clamp of the electrical connector illustrated in FIG. 33.
Figure 41:
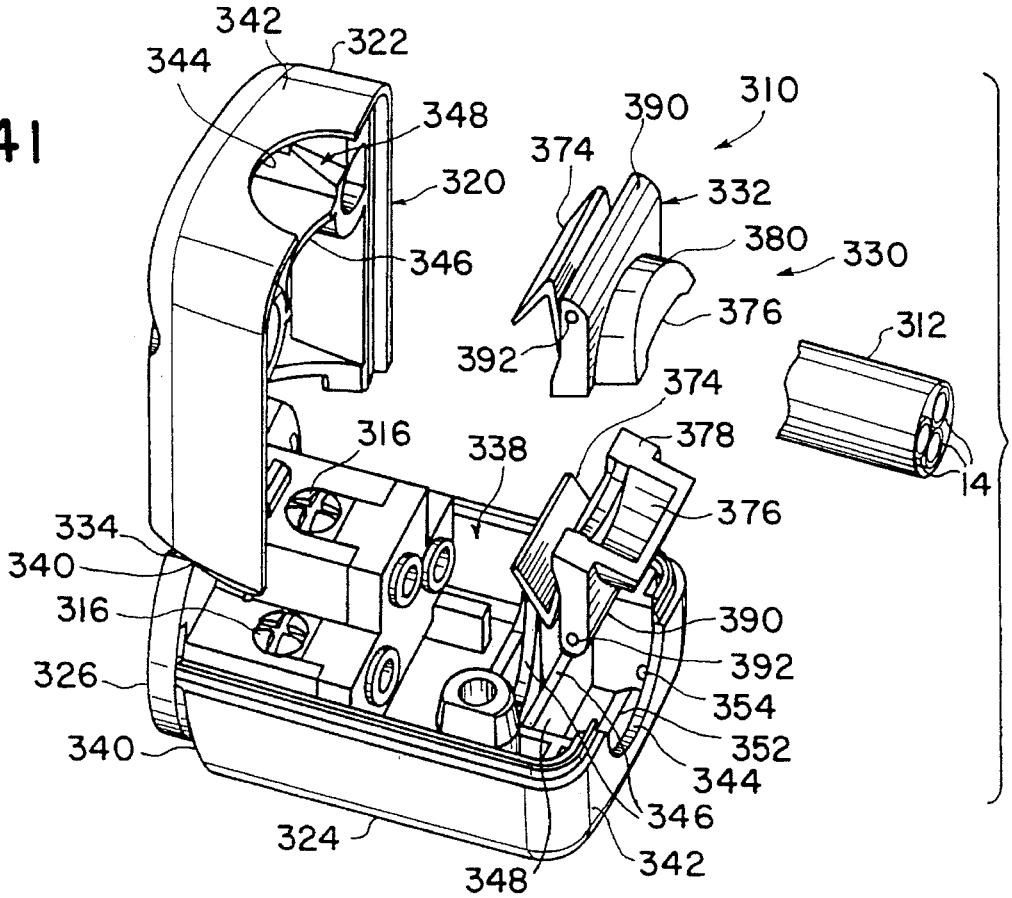
FIG. 41 is an exploded perspective view of an electrical connector and an electrical cord clamp in accordance with a fourth embodiment of the present invention.
Figure 42:
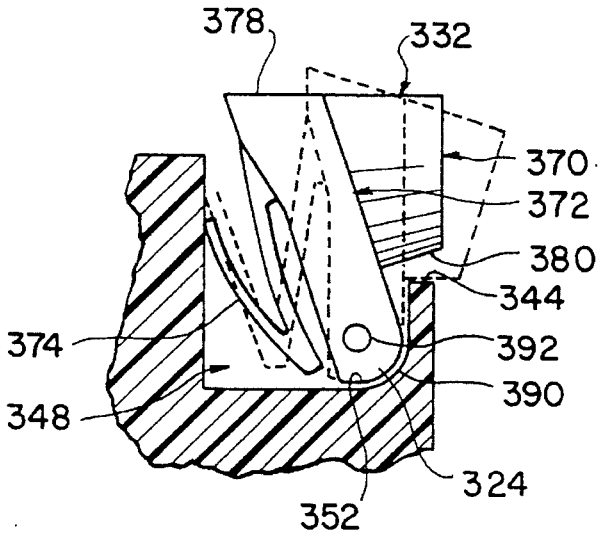
FIG. 42,,is a partial cross-sectional view of one of the clamping members and part of the electrical connector housing of FIG. 41, graphically and diagrammatically illustrating movement of the clamping member.
Figure 43:
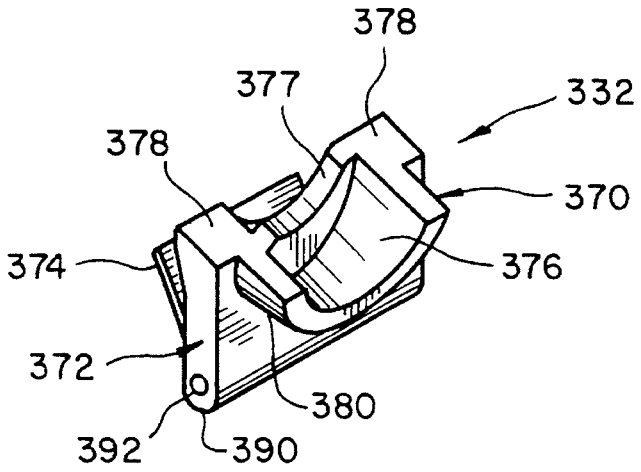
FIG. 43 is a perspective view of one of the clamping members for the cord clamp of the electrical connector illustrated in FIG. 41.
Figure 44:
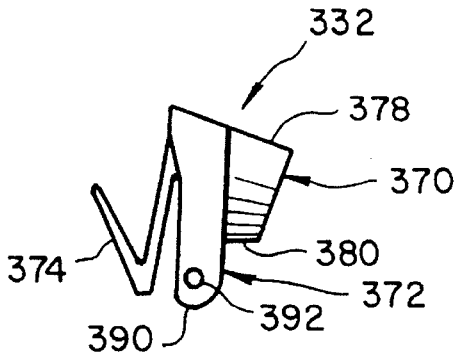
FIG. 44 is a side elevational view of the clamping member illustrated in FIG. 43 for the cord clamp of the electrical connector illustrated in FIG. 41.
Figure 45:
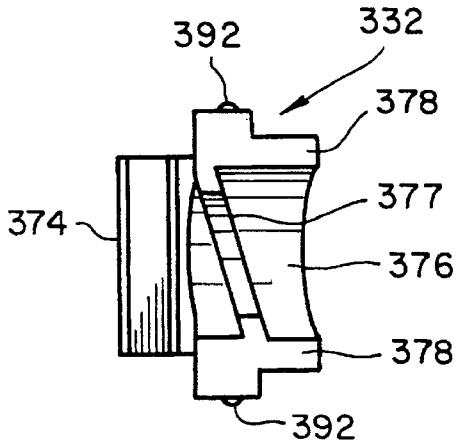
FIG. 45 is a top plan view of the clamping member illustrated in FIGS. 43 and 44 for the cord clamp of the electrical connector illustrated in FIG. 41.
Figure 46:
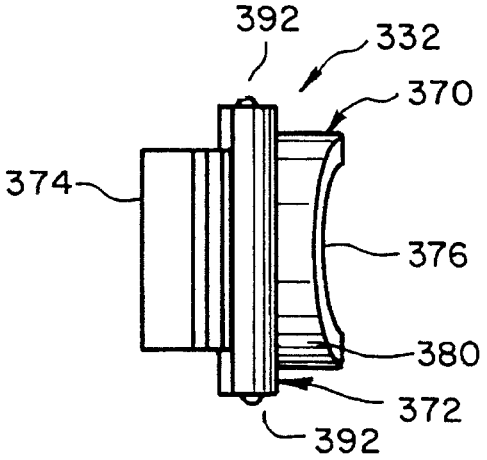
FIG. 46 is a bottom plan view of the clamping member illustrated in FIGS. 43–45 for the cord clamp of the electrical connector illustrated in FIG. 41.
Figure 47:
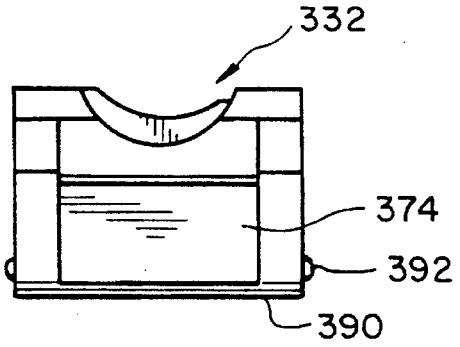
FIG. 47 is a first end elevational view of the clamping member illustrated in FIGS. 43–46 for the cord clamp of the electrical connector illustrated in FIG. 41.
Figure 48:
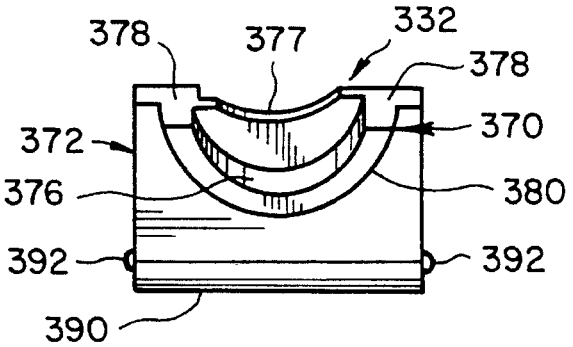
FIG. 48 is a second end elevational view of the clamping member illustrated in FIGS. 43–47 for the cord clamp of the electrical connector illustrated in FIG. 41.
Figure 49:
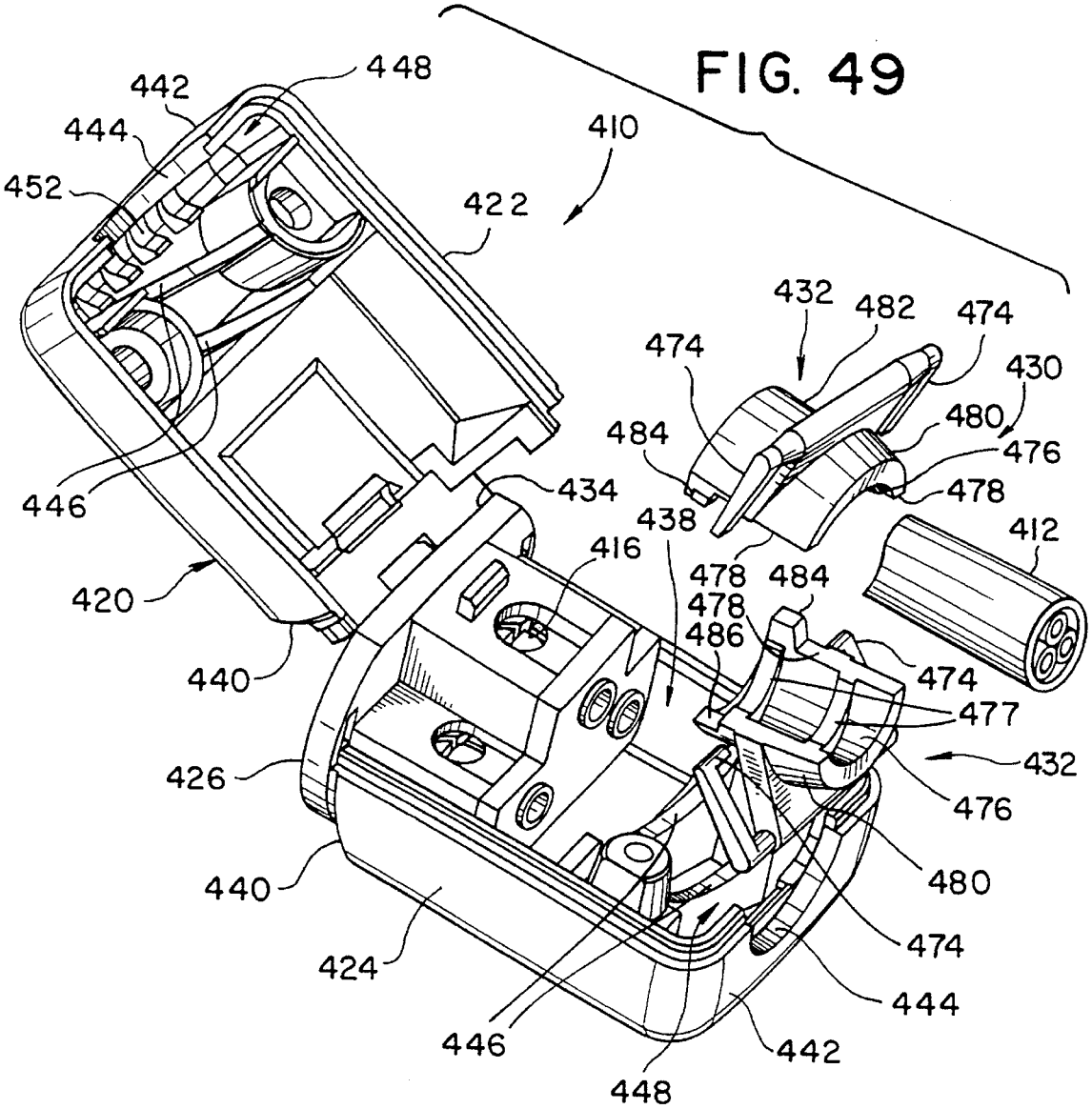
FIG. 49 is an exploded perspective view of an electrical connector and an electrical cord clamp in accordance with a fifth embodiment of the present invention.
Figure 50:
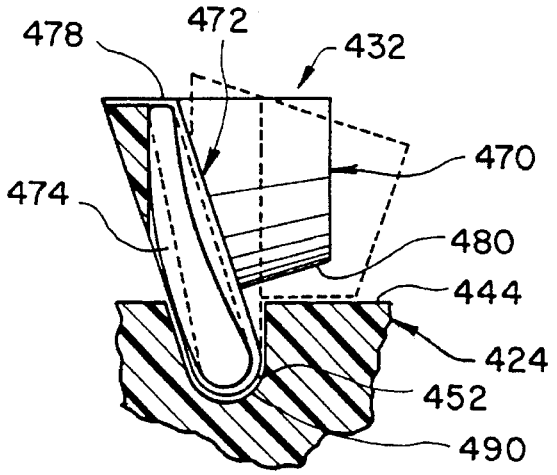
FIG. 50 is a partial cross-sectional view of one of the clamping members and part of the electrical connector housing of FIG. 49, graphically and diagrammatically illustrating movement of the clamping member.
Figure 51:
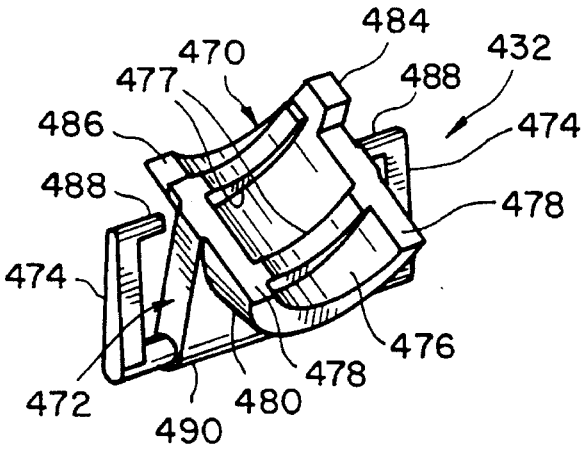
FIG. 51 is a perspective view of one of the clamping members for the cord clamp of the electrical connector illustrated in FIG. 49.
Figure 52:
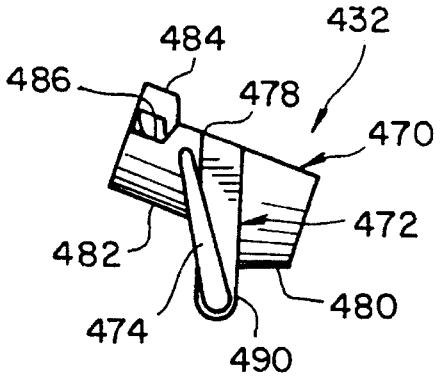
FIG. 52 is a side elevational view of the clamping member illustrated in FIG. 51 for the cord clamp of the electrical connector illustrated in FIG. 49.
Figure 53:
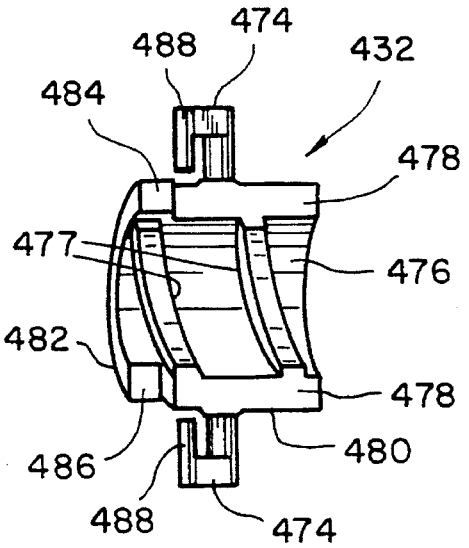
FIG. 53 is a top plan view of the clamping member illustrated in FIGS. 51 and 52 for the cord clamp of the electrical connector illustrated in FIG. 49.
Figure 54:
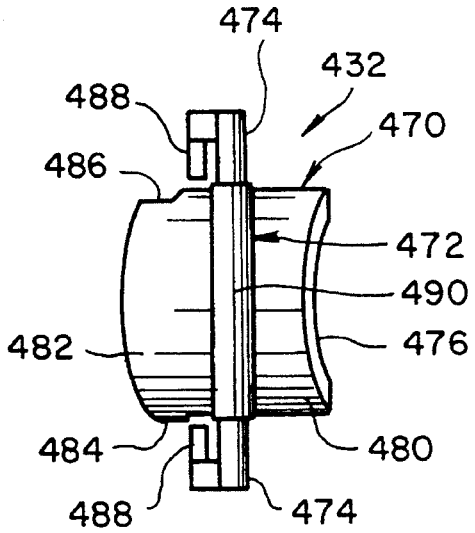
FIG. 54 is a bottom plan view of the clamping member illustrated in FIGS. 51–53 for the cord clamp of the electrical connector illustrated in FIG. 49.
Figure 55:
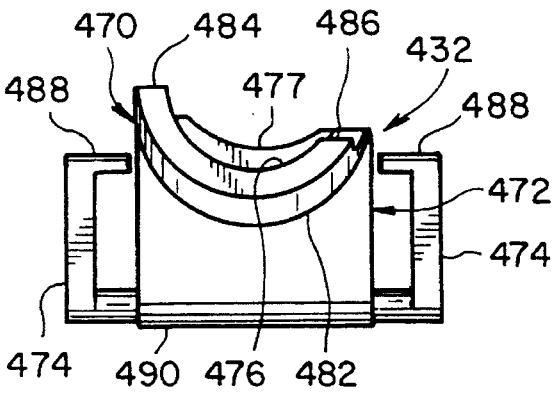
FIG. 55 is a firsthand elevational view of the clamping member illustrated in FIGS. 51–54 for the cord clamp of the electrical connector illustrated in FIG. 49.
Figure 56:
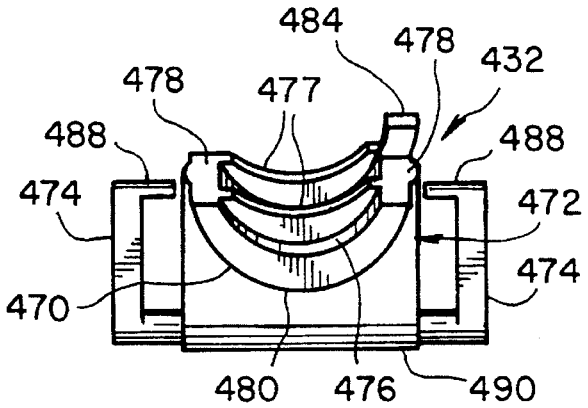
FIG. 56 is a second end elevational view of the clamping member illustrated in FIGS. 51–55 for the cord clamp of the electrical Connector illustrated in FIG. 49.
Figure 57:
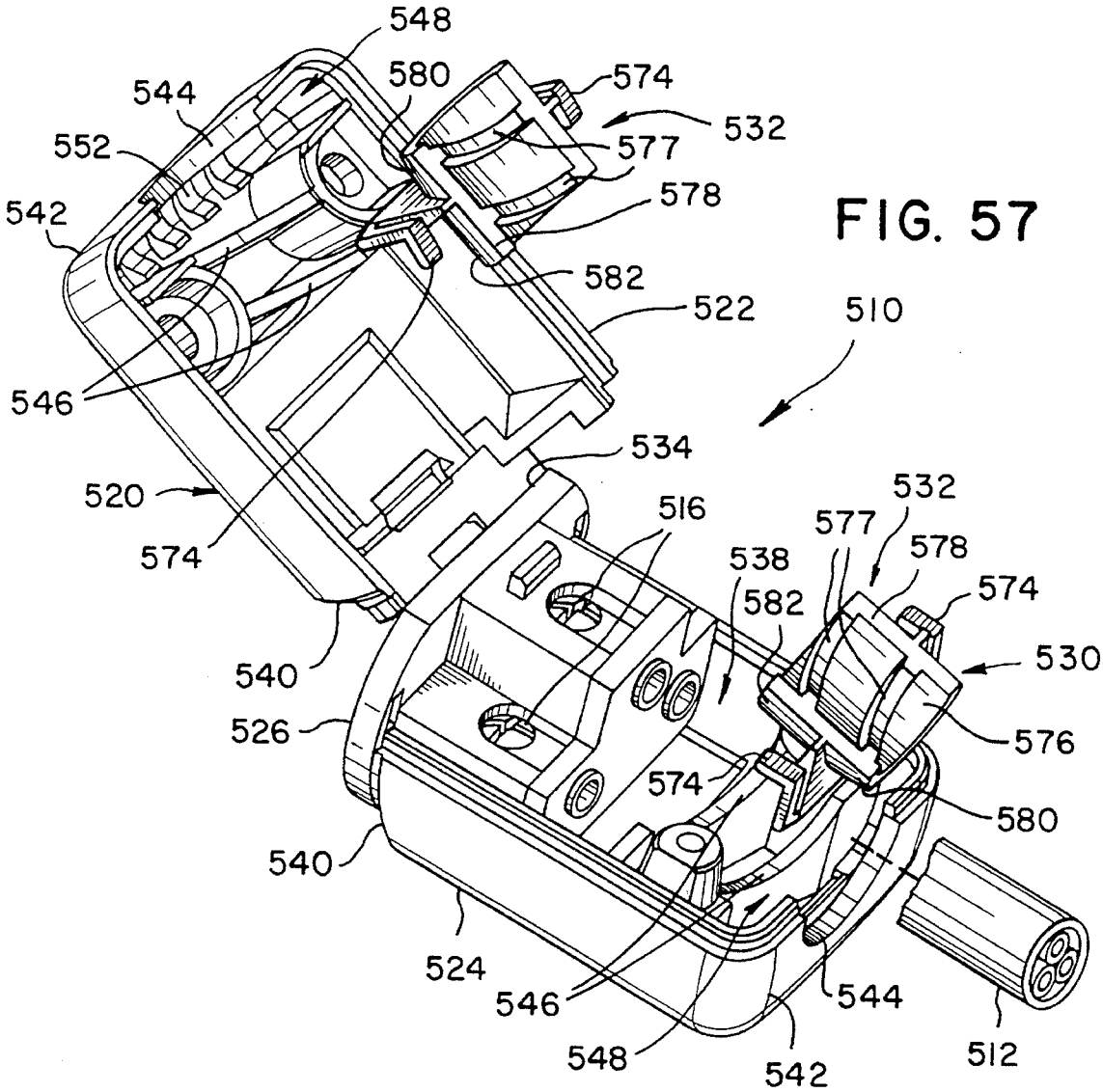
FIG. 57 is an exploded perspective view of an electrical connector and an electrical cord clamp in accordance with a sixth embodiment of the present invention.
Figure 58:
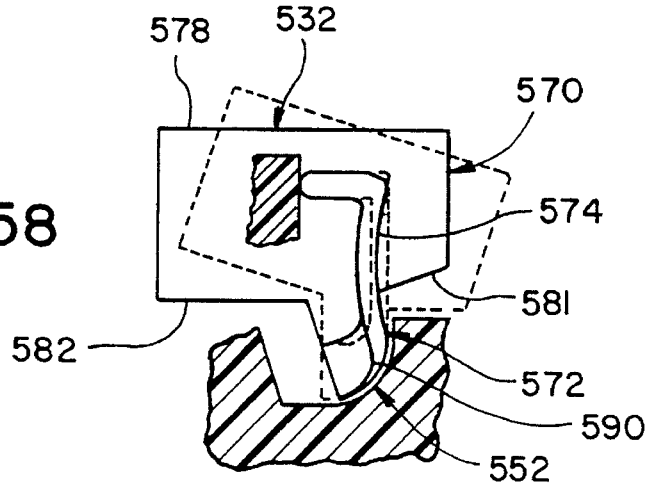
FIG. 58 is a partial cross-sectional view of one of the clamping members and part of the electrical connector housing of FIG. 57, graphically and diagrammatically illustrating movement of the clamping member.
Figure 59:
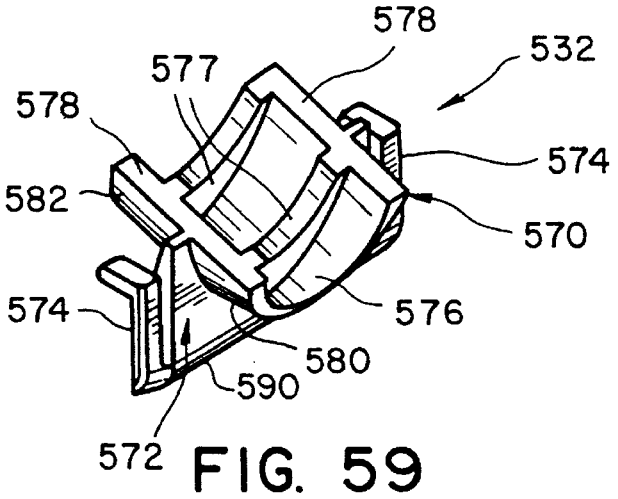
FIG. 59 is a perspective view of one of the clamping members for the cord clamp of the electrical connector illustrated in FIG. 57.
Figure 60:
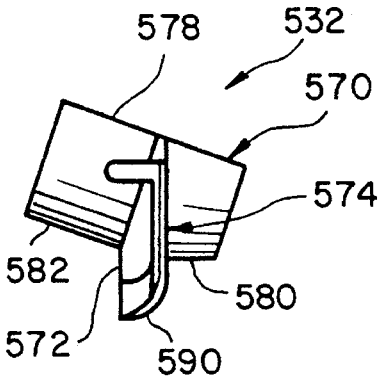
FIG. 60 is a side elevational view of the clamping member illustrated in FIG. 59 for the cord clamp of the electrical connector illustrated in FIG. 57.
Figure 61:
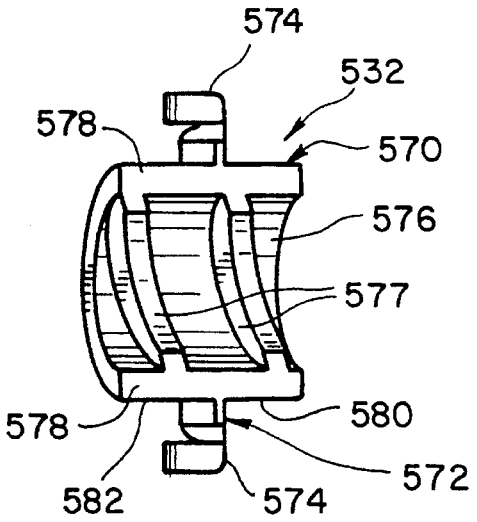
FIG. 61 is a top plan view of the clamping member illustrated in FIGS. 59 and 60 for the cord clamp of the electrical connector illustrated in FIG. 57.
Figure 62:
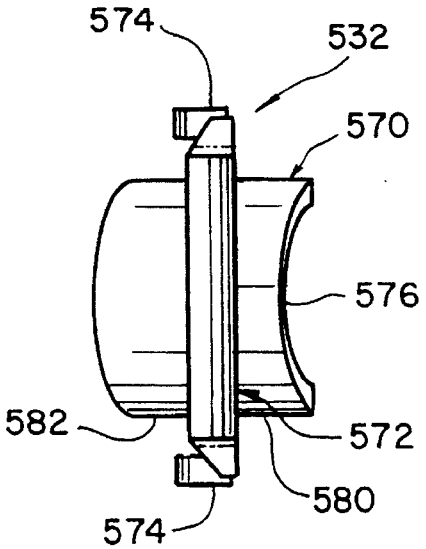
FIG. 62 is a bottom plan view of the clamping member illustrated in FIGS. 59–61 for the cord clamp of the electrical Connector illustrated in FIG. 57.
Figure 63:
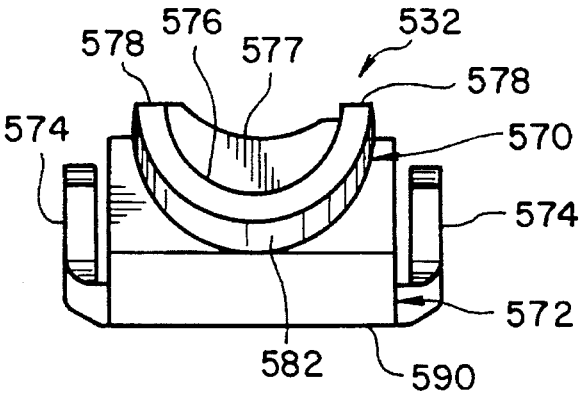
FIG. 63 is a first end elevational view of the clamping member illustrated in FIGS. 59–62 for the cord clamp of the electrical connector illustrated in FIG. 57.
Figure 64:
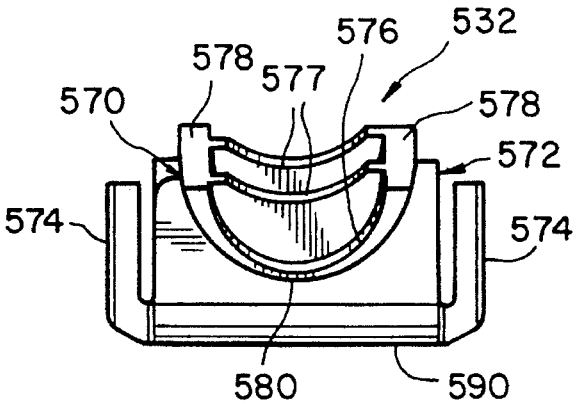
FIG. 64 is a second end elevational view of the clamping member illustrated in FIGS. 59–63 for the cord clamp of the electrical connector illustrated in FIG. 57.

As seen in FIGS. 5–15, clamping members 32 are received within guideways 48 which are formed adjacent cord opening 44 of cover halves 22 and 24. More specifically, as seen in FIGS. 4–6, each of the guideways 48 has two end ribs 50 with bearing surfaces 52, a center rib 54 with a curved socket 56, and a pair of recesses 58.

Bearing surfaces 52 are designed to control the tilting movement of clamping members 32 such that clamping members 32 tilt about bearing surfaces 52 upon assembly of electrical connector housing 20 about the end of electrical cord 12. Bearing surfaces 52 are preferably curved cutouts with its center axis extending substantially perpendicular to the end of electrical cord 12 which extends into electrical connector housing 20 via cord openings 44. Bearing surfaces 52 have a curvature of less than 180° so that clamping members 32 can tilt therein. Accordingly, clamping members 32, as discussed in more detail below, pivot on bearing surfaces 52 about an axis extending substantially perpendicular to the longitudinal axis of electrical cord 12 where it extends into electrical connector housing 20.

Curved socket 56 is a curved notch with its center axis aligned with the center axes of bearing surfaces 52. However, unlike bearing surfaces 52, curved socket 56 has its inner surface extending through an arc of about 235°. Sockets 56 perform the dual function of bearing surfaces for tilting of clamping members 32 and retaining members for coupling clamping members 32 to housing 20.

Clamping members 32 are substantially identical and are preferably retained within their respective cover halves 22 or 24 such that clamping members 32 are retained thereto by a snap-fit. More specifically, clamping members 32 each includes a body portion 70 for engaging and gripping electrical cord 12, a flange portion 72 for engaging bearing surfaces 52 and sockets 56 of its respective cover half 22 or 24, and a pair of spring elements or arms 74. Body portion 70 has a curved cord recess 76 with a pair of curved clamping ribs 77 formed thereon, a pair of flat, tilting surfaces 78 formed on the sides of cord recess 76 and a pair of curved outer surfaces 80 and 82.

Body portion 70 is angled relative to flange portion 72 such that when clamping members 32 are installed in their respective cover halves 22 and 24, body portions 70 of each of the clamping members 32 are angled towards each other. Accordingly, the innermost end of the clamping members are closest to each other and diverge from each other as they approach the exterior facing ends. In order to ensure that clamping members 32 properly tilt relative to each other, the inner end of body portion 70 is provided with a tooth 84 extending outwardly from one of the tilting surfaces 78 and a notch 86 formed in the other of the tilting surfaces 78. Accordingly, tooth 84 of each of the clamping members is designed to engage the notch 86 on the other of the clamping members. This tooth and notch arrangement in the clamping members assures that the clamping members 32 are equally tilted with squeezed about electrical cord 12. If this tooth and notch arrangement of the clamping members 32 was eliminated, one of the clamping members 32 could tilt more than the other clamping member 32 when coupled about electrical cord 12.

Spring elements or arms 74 are designed to be received within recesses 58 of cover halves 22 and 24 such that clamping members 32 are normally biased such that curved outer surfaces 80 of clamping members 32 engage cord openings 44 of cover halves 22 and 24. In other words, when clamping members 32 are installed on cover halves 22 and 24, this causes spring elements or arms 74 to be received within recesses 58 of cover halves 22 and 24 so as to preload spring elements or arms 74.

Flange portion 72 extends outwardly from body portion 70, and has a curved bearing surface 90 at its free end and a centrally located recess 92 which extends through body portion 70. Accordingly, when clamping members 32 are coupled to cover halves 22 and 24 respectively, curved bearing surfaces 90 of clamping members 32 engage bearing surfaces 52 of cover halves 22 and 24. Bearing surfaces 52 along recesses 92 also engage sockets 56 of cover halves 22 and 24 for releasably coupling clamping members 32 thereto via a snap-fit.

In its rest state, spring elements or arm 74 hold clamping members 32 within cover halves 22 and 24 such that curved outer surfaces 80 of body portions 70 engage cord openings 44 and flange portions 72 engage the interior surface of bearing surfaces 52 and sockets 56. In this manner, tilting surfaces 78 of each of the clamping members form an angle relative to a longitudinal plane passing through the center of the electrical cord.

When housing halves 22 and 24 are partially closed, tilting surfaces 78 of clamping members 32 initially engage each other or cord 12 at an angle. Further, closure of housing halves 22 and 24 causes clamping members 32 to tilt about bearing surfaces 52 and 90 against the force of spring elements or arms 74. This tilting movement of clamping members 32 causes electrical cord 12 to be engaged by ribs 77 which in turn axially pulls electrical cord 12 towards terminals 16 so as to provide strain relief between the ends of electrical conductors 14 and terminals 16. Preferably, cord clamping members 32 and cord 12 are axially displaced in the range of about 0.031 inch to about 0.092 inch. Clamping members 32 continue to tilt until tilting surfaces 78 of each of the clamping members 32 are tilted so that they are fully engaged with each other, i.e., parallel to each other and to a plane passing through the electrical cord 12. In this position, curved outer surfaces 82 of clamping members 32 rest on one of the ribs 46 of its respective cover half 22 or 24.

Electrical Wiring Device or Connector 110

Referring now to FIGS. 22–32, an electrical wiring device or cord connector 110 with a strain relief arrangement is illustrated in accordance with a second embodiment of the present invention. More specifically, electrical connector 110 is attached to one end of an electrical cord 112 such that during assembly thereof, the strain relief arrangement of electrical connector 110 will axially pull electrical cord 112 therein. Electrical connector 110 is a modified version of electrical connector 10. Thus, many of the features which are common between the electrical connectors will not be discussed in detail when referring to this second embodiment.

As seen in FIGS. 22–25, electrical cord 112 is a conventional electrical cord, and thus, will not be discussed in detail. By way of example, electrical cord 112, as seen in the drawings, preferably has three electrical conductors 114 which have a conducting core and an insulating sheath thereon. The ends of the electrical conductors 114 are stripped for attaching to terminals 116. While three conductors 114 are illustrated, it will be apparent to those skilled in the art that the present invention can be utilized with an electrical cord with two electrical conductors or with an electrical cord more than three electrical conductors. Of course, housing 120 would have to be modified to accommodate the additional conductor or conductors.

Electrical connector 110 has a housing 120 with a first cover half 122, a second cover half 124, a front cover face 126 and a contact retainer body 128. Electrical connector 110 also has a cord clamp 130 movably coupled within housing 120. Cord clamp 130 includes a pair of clamping members 132 which are designed to provide strain relief for an electrical cord 112 coupled to electrical connector 110. More specifically, clamping members 132 of cord clamp 130 engage electrical cord 112 during assembly of electrical connector 110 to axially pull electrical cord 112 towards terminals 116 of electrical connector 110. Clamping members 132 are explained In more detail below.

Preferably, first cover half 122, second cover half 124 and front cover face 126 along with contact retainer body 128 are all integrally formed as a one-piece, integral unit of a suitable insulating material such as nylon. More specifically, first cover half 122 and second cover half 124 are hinged to front cover face 126 by web hinges 134, while contact retainer body 128 is integrally formed with front cover face 126 and extends from the interior surface of front cover face 126 between cover halves 122 and 124.

Electrical connector housing 120 is held in its assembled position by a pair of screws (not shown). 0f course, other types of fastening members can be used to hold cover halves 122 and 124 together.

Cover halves 122 and 124 are substantially identical for purposes of discussion of this invention. Of course, as seen in the Figures, there are some minor differences between cover halves 122 and 124 for mating of cover halves 122 and 124 together during assembly thereof. Accordingly, like reference numerals will be utilized to discuss the parts which are common between cover halves 122 and 124.

Cover halves 122 and 124 form a cord receiving cavity 138 for receiving cord clamp 130, electrical cord 112 and contact retainer body 128 therein. More specifically, each of the cover halves 122 and 124 have an open end 140 coupled to front cover face 126 by web hinges 134, and a closed end 142 with a semi-circular cord opening 144. Each of the cover halves 122 and 124 further includes a pair of ribs 146 adjacent cord opening 144 for clamping electrical cord 112 when cord clamp 130 is not utilized.

Clamping members 132 are received within guideways 148 which are formed adjacent cord opening 144 of cover halves 122 and 124. Guideways 148 are partially formed by a pair of spring elements or arms 150 and a bearing surface 152. Spring elements 150 each includes a protrusion 154 for engaging its respective clamping member 132 so that clamping members 132 are retained to its respective cover halves 122 and 124. Spring elements 150 are also designed to control the tilting movement of clamping members 132 such that the clamping members 132 tilt about bearing surfaces 152 upon assembly of electrical connector housing 120 about the end of electrical cord 112.

Bearing surfaces 152 are preferably curved recesses with their center axis extending substantially perpendicular to the end of electrical cord 112 extending into electrical connector housing 120 via cord openings 144. Accordingly, clamping members 132, as discussed in more detail below, pivot about an axis extending substantially perpendicular to the longitudinal axis of electrical cord 112 where it extends into electrical connector housing 120.

Clamping members 132 are substantially identical and are preferably retained within their respective cover halves 122 or 124 such that clamping members 132 are retained thereto by a snap-fit. More specifically, clamping members 132 each includes a body portion 170 for engaging and gripping electrical cord 112 and a flange portion 172 for engaging its respective cover half 122 or 124. Body portion 170 has a curved cord recess 176 with at least one rib 177 formed thereon, a pair of tilting surfaces 178 and a curved outer surface 180.

Flange portion 172 extends outwardly from body portion 170, and has a curved bearing surface 190 at its free end and a pair of notches 192 formed adjacent body portion 170. Accordingly, when clamping members 132 are coupled to cover halves 122 and 124 respectively, curved bearing surfaces 190 engage bearing surfaces 152 of cover halves 122 and 124, while notches 192 of clamping members 132 engage protrusions 154 of cover halves 122 and 124.

In its rest state, spring elements 150 hold clamping members 132 within cover halves 122 and 124 such that curved surface 180 of body portion 170 engages cord openings 144 and flange portion 172 engages the interior surface of each of the cover halves 122 or 124 at second ends 142. In this manner, tilting surfaces 178 of each of the clamping members form an angle relative to a longitudinal plane passing through the center of the electrical cord.

When housing halves 122 and 124 are partially closed, tilting surfaces 178 of clamping members 132 initially engage each other or cord 112 at an angle. Further, closure of housing halves 122 and 124 causes clamping members 132 to tilt about bearing surfaces 152 and 190 against the force of spring elements or arm 150. This tilting movement of clamping members 132 causes electrical cord 112 to be engaged by ribs 177 which in turn axially pulls electrical cord 112 towards terminals 116 so as to provide strain relief between the ends of electrical conductors 114 and terminals 116. Preferably, cord clamping members 132 and cord 112 are axially displaced in the range of about 0.031 inch to about 0.092 inch. Clamping members 132 continue to tilt until tilting surfaces 178 of each of the clamping members are tilted so that they are fully engaged with each other, i.e., parallel to each other and to a plane passing through the electrical cord 112.

Electrical Wiring Device or Connector 210

Referring now to FIGS. 33–40, an electrical wiring device or cord connector 210 with a strain relief arrangement is illustrated in accordance with a third embodiment of the present invention. More specifically, electrical connector 210 is attached to one end of an electrical cord 212 such that during assembly thereof, the strain relief arrangement of electrical connector 210 will axially pull electrical cord 212 therein.

Electrical connector 210 has a housing 220 with a first cover half 222, a second cover half 224, a front cover face 226 and a contact retainer body 228. Electrical connector 210 also has a cord clamp 230 movably coupled within housing 220. Cord clamp 230 includes a pair of clamping members 232 which are designed to provide strain relief for an electrical cord 212 coupled to electrical connector 210. More specifically, clamping members 232 of cord clamp 230 engage electrical cord 212 during assembly of electrical connector 210 to axially pull electrical cord 212 towards terminals 216 of electrical connector 210.

Cover halves 222 and 224 are substantially identical for purposes of discussion of this invention. Of course, as seen in the Figures, there are some minor differences between cover halves 222 and 224 for mating of cover halves 222 and 224 together during assembly thereof. Accordingly, like reference numerals will be utilized to discuss the parts which are common between cover halves 222 and 224.

Cover halves 222 and 224 form a cord receiving cavity 238 for receiving cord clamp 230, electrical cord 212 and contact retainer body 228 therein. More specifically, each of the cover halves 222 and 224 have an open end 240 coupled to front cover face 226 by web hinges 234, and a closed end 242 with a semi-circular cord opening 244. Each of the cover halves 222 and 224 further includes a rib 246 adjacent cord opening 244 for clamping electrical cord 212 when cord clamp 230 is not utilized.

Clamping members 232 are received within guideways 248 which are formed adjacent cord opening 244 of cover halves 222 and 224. Guideways 248 each has a bearing surface 252 for tiltably supporting its respective clamping member 232 therein. Each of the guideways 248 also has a pair of recesses 254 located at its opposite side walls adjacent bearing surface 252 for releasably retaining its respective clamping member 232 therein.

Bearing surface 252 is preferably a curved bearing surface that extends substantially perpendicular to the end of electrical cord 212 extending into electrical connector housing 220 via cord openings 244. Accordingly, clamping members 232, as discussed in more detail below, pivot or tilt about an axis extending substantially perpendicular to the longitudinal axis of electrical cord 212 where it extends into electrical connector housing 220.

Clamping members 232 are substantially identical and are preferably retained within their respective cover halves 222 or 224 such that clamping members 232 are retained thereto by a snap-fit. More specifically, clamping members 232 each includes a body portion 270 for engaging and gripping electrical cord 212, a flange portion 272 for engaging its respective cover half 222 or 224, and a spring element or arm 274. Body portion 270 of each clamping member 232 has a curved cord recess 276 with at least one rib 277 formed thereon for engaging electrical cord 212, a pair of tilting surfaces 278 for engaging the tilting surfaces of the other clamping member 232, and a curved outer surface 280 for engaging its respective cord opening 244.

Flange portion 272 of each clamping member 232 extends outwardly from body portion 270, and has a curved bearing surface 290 at its free end and a pair of protrusions 292 formed on its sides adjacent its free end for engaging its respective recess 254 via a snap-fit. Accordingly, when clamping members 232 are coupled to cover halves 222 and 224 respectively, curved bearing surfaces 290 of clamping members 232 engage bearing surfaces 252 of cover halves 222 and 224.

In its rest state, spring elements 274 of clamping members 232 engage cover halves 222 and 224 such that clamping members 232 are tilted until curved surfaces 280 of body portions 270 engage cord openings 244 of cover halves 222 and 224, respectively. In this manner, tilting surfaces 278 of each of the clamping members 232 form an angle relative to a longitudinal plane passing through the center of the electrical cord 212.

When housing halves 222 and 224 are partially closed, tilting surfaces 278 of clamping members 232 initially engage each other at an angle. Further, closure of housing halves 222 and 224 causes clamping members 232 to tilt about bearing surfaces 252 and 290 against the force of spring elements 274. This tilting movement of clamping members 232 causes electrical cord 212 to be engaged by ribs 277 which in turn axially pulls electrical cord 212 towards terminals 216 so as to provide strain relief between the end of electrical cord 212 and terminals 216. Clamping members 232 continue to tilt until tilting surfaces 278 of each of the clamping members 232 are tilted so that they are fully engaged with each other, i.e., parallel to each other and to a plane passing through the electrical cord 212.

Electrical Wiring Device or Connector 310

Referring now to FIGS. 41–48, an electrical wiring device or cord connector 310 with a strain relief arrangement is illustrated in accordance with a fourth embodiment of the present invention. More specifically, electrical connector 310 is attached to one end of an electrical cord 312 such that during assembly thereof, the strain relief arrangement of electrical connector 310 will axially pull electrical cord 312 therein.

Electrical connector 310 is substantially identical to electrical connector 210, discussed above, except that the strain relief arrangement has been slightly changed as discussed below. Accordingly, electrical connector 310 will not be discussed in as much detail herein.

Electrical connector 310 has a housing 320 with a first cover half 322, a second cover half 324, a front cover face 326 and a contact retainer body 328. Electrical connector 310 also has a cord clamp 330 movably coupled within housing 320. Cord clamp 330 includes a pair of clamping members 332 which are designed to provide strain relief for an electrical cord 312 coupled to electrical connector 310. More specifically, clamping members 332 of cord clamp 330 engage electrical cord 312 during assembly of electrical connector 310 to axially pull electrical cord 312 towards terminals 316 of electrical connector 310.

Cover halves 322 and 324 are substantially identical for purposes of discussion of this invention. Of course, as seen in the Figures, there are some minor differences between cover halves 322 and 324 for mating of cover halves 322 and 324 together during assembly thereof. Accordingly, like reference numerals will be utilized to discuss the parts which are common between cover halves 322 and 324.

Cover halves 322 and 324 form a cord receiving cavity 338 for receiving cord clamp 330, electrical cord 312 and contact retainer body 328 therein. More specifically, each of the cover halves 322 and 324 have an open end 340 coupled to front cover face 326 by web hinges 334, and a closed end 342 with a semi-circular cord opening 344. Each of the cover halves 322 and 324 further includes a rib 346 adjacent cord opening 344 for clamping electrical cord 312 when cord clamp 330 is not utilized.

Clamping members 332 are received within guideways 348 which are formed adjacent cord opening 344 of cover halves 322 and 324. Guideways 348 each has a bearing surface 352 for tiltably supporting its respective clamping member 332 therein. Each of the guideways 348 also has a pair of recesses 354 located at its opposite side walls adjacent bearing surface 352 for releasably retaining its respective clamping member 332 therein.

Bearing surface 352 is preferably a curved bearing surface that extends substantially perpendicular to the end of electrical cord 312 extending into electrical connector housing 320 via cord openings 344. Accordingly, clamping members 332, as discussed in more detail below, pivot or tilt about an axis extending substantially perpendicular to the longitudinal axis of electrical cord 312 where it extends into electrical connector housing 320.

Clamping members 332 are substantially identical and are preferably retained within their respective cover halves 322 or 324 such that clamping members 332 are retained thereto for tilting movement by a snap-fit. More specifically, clamping members 332 each includes a body portion 370 for engaging and gripping electrical cord 312, a flange portion 372 for engaging its respective cover half 322 or 324, and a spring element or arm 374. Body portion 370 of each clamping member 332 has a curved cord recess 376 with at least one rib 377 formed thereon for engaging electrical cord 312, a pair of tilting surfaces 378 for engaging the tilting surface of the other clamping member 332, and a curved outer surface 380 for engaging its respective cord opening 244.

Flange portion 372 of each clamping member 332 extends outwardly from body portion 370, and has a curved bearing surface 390 at its free end and a pair of protrusions 392 formed on its sides adjacent its free end for engaging recesses 354 via a snap-fit. Accordingly, when clamping members 332 are coupled to cover halves 322 and 324 respectively, curved bearing surfaces 390 of clamping members 332 engage bearing surfaces 352 of cover halves 322 and 324.

In its rest state, spring elements 374 of clamping members 332 engage cover halves 322 and 324 such that curved surfaces 380 of body portions 370 engage cord openings 344 of cover halves 322 and 324. In this manner, tilting surfaces 378 of each of the clamping members 332 form an angle relative to a longitudinal plane passing through the center of the electrical cord 312.

When housing halves 322 and 324 are partially closed, tilting surfaces 378 of clamping members 332 initially engage each other at an angle. Further, closure of housing halves 322 and 324 causes clamping members 332 to tilt about bearing surfaces 352 and 390 against the force of spring elements 374. This tilting movement of clamping members 332 causes electrical cord 312 to be engaged by ribs 377 which in turn axially pulls electrical cord 312 towards terminals 316 so as to provide strain relief between the end of electrical cord 312 and terminals 316. Clamping members 332 continue to tilt until tilting surfaces 378 of each of the clamping members 332 are tilted so that they are fully engaged with each other, i.e., parallel to each other and to a plane passing through the electrical cord 312.

Electrical Wiring Device or Connector 410

Referring now to FIGS. 49–56, an electrical wiring device or cord connector 410 with a strain relief arrangement is illustrated in accordance with a fifth embodiment of the present invention. More specifically, electrical connector 410 is attached to one end of an electrical cord 412 such that during assembly thereof, the strain relief arrangement of electrical connector 410 will axially pull electrical cord 412 therein.

Electrical connector 410 is substantially identical to electrical connector 10, discussed above, except that the strain relief arrangement has been slightly modified as discussed below. Accordingly, electrical connector 410 will not be discussed in as much detail herein as electrical connector 10.

Electrical connector 410 has a housing 420 with a first cover half 422, a second cover half 424, a front cover face 426 and a contact retainer body 428. Electrical connector 410 also has a cord clamp 430 movably coupled within housing 420. Cord clamp 430 includes a pair of clamping members 432 which are designed to provide strain relief for an electrical cord 412 coupled to electrical connector 410. More specifically, clamping members 432 of cord clamp 430 engage electrical cord 412 during assembly of electrical connector 410 to axially pull electrical cord 412 towards terminals 416 of electrical connector 410.

Cover halves 422 and 424 are substantially identical for purposes of discussion of this invention. Of course, as seen in the Figures, there are some minor differences between cover halves 422 and 424 for mating of cover halves 422 and 424 together during assembly thereof. Accordingly, like reference numerals will be utilized to discuss the parts which are common between cover halves 422 and 424.

Cover halves 422 and 424 form a cord receiving cavity 438 for receiving cord clamp 430, electrical cord 412 and contact retainer body 428 therein. More specifically, each of the cover halves 422 and 424 have an open end 440 coupled to front cover face 426 by web hinges 434, and a closed end 442 with a semi-circular cord opening 444. Each of the cover halves 422 and 424 further includes a pair of ribs 446 adjacent cord opening 444 for clamping electrical cord 412 when cord clamp 430 is not utilized.

Clamping members 432 are received within guideways 448 which are formed adjacent cord opening 444 of cover halves 422 and 424. Guideways 448 each has a bearing surface 452 for tiltably supporting its respective clamping member 432 therein.

Bearing surface 452 is preferably a curved bearing surface that extends substantially perpendicular to the end of electrical cord 412 extending into electrical connector housing 420 via cord openings 444. Accordingly, clamping members 432, as discussed in more detail below, pivot or tilt about an axis extending substantially perpendicular to the longitudinal axis of electrical cord 412 where it extends into electrical connector housing 420.

Clamping members 432 are substantially identical, and each includes a body portion 470 for engaging and gripping electrical cord 412, a flange portion 472 for engaging the bearing surface 452 of the bearing surface 452 of its respective cover half 422 or 424 and a pair of spring elements or arms 474. Body portion 470 has a curved cord recess 472 with at least one rib 477 formed thereon, a pair of tilting surfaces 478 and a pair of curved outer surfaces 480 and 482.

Body portion 470 is angled relative to flange portion 472 such that when clamping members 432 are installed in their respective cover halves 422 and 424, body portions 470 of each of the clamping members 432 are angled towards each other. Accordingly, the innermost end of the clamping members 432 are closest to each other and diverge from each other as they approach the exterior facing ends.

In order to ensure that clamping members 432 properly tilt relative to each other, the inner end of body portion 470 is provided with a tooth 484 extending outwardly from one of the tilting surfaces 478 and a notch 486 formed in the other of the tilting surfaces 478. Accordingly, tooth 484 of each of the clamping members 432 is designed to engage the notch 486 on the other of the clamping members 432. This tooth and notch arrangement of the clamping members 432 assures that the clamping members 432 are equally tilted with squeezed about electrical cord 412. If this tooth and notch arrangement of the clamping members 432 was eliminated, one of the clamping members 432 could tilt more than the other clamping member 432 when coupled about electrical cord 412.

Spring elements or arms 474 of each of the clamping members 432 are designed to engage the ends of the ribs 446 which form part of guideway 448 such that clamping members 432 are normally biased such that curved outer surfaces 480 of clamping members 432 engage cord openings 444 of cover halves 422 and 424. In other words, when clamping members 432 are installed on cover halves 422 and 424, spring elements or arms 474 engage one of the ribs 446 of its respective cover halves 422 and 424 so as to preload spring elements or arms 474. This preload of spring elements or arms 474 also acts as retaining means to releasably couple or retain clamping member 432 with its respective cover half 422 or 424.

Spring elements 474 can also be provided with a pair of inwardly extending portions 488 at their free ends. Portions 488 are designed to prevent spring elements or arms 474 from becoming tangled with other clamping members during manufacture thereof.

Flange portion 472 extends outwardly from body portion 470, and has a curved bearing surface 490 at its free end for tiltably engaging its respective bearing surface 452 of its respective cover half 422 or 424. In other words, when clamping members 432 are coupled to cover halves 422 and 424 respectively, curved bearing surfaces 490 engage bearing surfaces 452 of cover halves 422 and 424 to allow tilting movement of clamping members 432 within housing 420.

In its rest state, spring elements 474 are preloaded to hold clamping members 432 within cover halves 422 and 424 such that curved surface 480 of body portion 470 engages cord openings 444 and flange portion 472 engages the interior surface of each of the cover halves 422 or 424 at second ends 442. In this manner, tilting surfaces 478 of each of the clamping members 432 form an angle relative to a longitudinal plane passing through the center of the electrical cord.

When housing halves 422 and 424 are partially closed, tilting surfaces 478 of clamping members 432 initially engage each other at an angle. Further, closure of housing halves 422 and 424 causes clamping members 432 to tilt about bearing surfaces 452 and 490 against the force of spring elements 474. This tilting movement of clamping members 432 causes electrical cord 412 to be engaged by ribs 477 which in turn axially pulls electrical cord 412 towards terminals 416 so as to provide strain relief between the end of electrical cord 412 and terminals 416. Clamping members 432 continue to tilt until tilting surfaces 478 of each of the clamping members 432 are tilted so that they are fully engaged with each other, i.e., parallel to each other and to a plane passing through the electrical cord 412.

Electrical Wiring Device or Connector 510

Referring now to FIGS. 57–64, an electrical wiring device or cord connector 510 with a strain relief arrangement is illustrated in accordance with a sixth embodiment of the present invention. More specifically, electrical connector 510 is attached to one end of an electrical cord 512 such that during assembly thereof, the strain relief arrangement of electrical connector 510 will axially pull electrical cord 512 therein.

Electrical connector 510 is substantially identical to electrical connectors 10 and 410, discussed above, except that the strain relief arrangement has been slightly modified as discussed below. Accordingly, electrical connector 510 will not be discussed in as much detail herein.

Electrical connector 510 has a housing 520 with a first cover half 522, a second cover half 524, a front cover face 526 and a contact retainer body 528. Electrical connector 510 also has a cord clamp 530 movably coupled within housing 520. Cord clamp 530 includes a pair of clamping members 532 which are designed to provide strain relief for an electrical cord 512 coupled to electrical connector 510. More specifically, clamping members 532 of cord clamp 530 engage electrical cord 512 during assembly of electrical connector 510 to axially pull electrical cord 512 towards terminals 516 of electrical connector 510.

Cover halves 522 and 524 are substantially identical for purposes of discussion of this invention. Of course, as seen in the Figures, there are some minor differences between cover halves 522 and 524 for mating of cover halves 522 and 524 together during assembly thereof. Accordingly, like reference numerals will be utilized to discuss the parts which are common between cover halves 522 and 524.

Cover halves 522 and 524 form a cord receiving cavity 538 for receiving cord clamp 530, electrical cord 512 and contact retainer body 528 therein. More specifically, each of the cover halves 522 and 524 have an open end 540 coupled to front cover face 526 by web hinges 534, and a closed end 542 with a semi-circular cord opening 544. Each of the cover halves 522 and 524 further includes a pair of ribs 546 adjacent cord opening 544 for clamping electrical cord 512 when cord clamp 530 is not utilized.

Clamping members 532 are received within guideways 548 which are formed adjacent cord opening 544 of cover halves 522 and 524. Guideways 448 each has a bearing surface 552 for tiltably supporting its respective clamping member 532 therein.

Bearing surface 552 is preferably a curved bearing surface that extends substantially perpendicular to the end of electrical cord 512 extending into electrical connector housing 520 via cord openings 544. Accordingly, clamping members 532, as discussed in more detail below, pivot or tilt about an axis extending substantially perpendicular to the longitudinal axis of electrical cord 512 where it extends into electrical connector housing 520.

Clamping members 532 are substantially identical, and each includes a body portion 570 for engaging and gripping electrical cord 512, a flange portion 572 for engaging the bearing surface 552 of its respective cover half 522 or 524, and a pair of L-shaped spring elements or arms 574. Body portion 570 has a curved cord recess 572 with at least one rib 577 formed thereon, a pair of tilting surfaces 578 and a pair of curved outer surfaces 580 and 582.

Body portion 570 is angled relative to flange portion 572 such that when clamping members 532 are installed in their respective cover halves 522 and 524, body portions 570 of each of the clamping members 532 are angled towards each other. Accordingly, the innermost end of the clamping members 532 are closest to each other and diverge from each other as they approach the exterior facing ends.

Spring elements or arms 574 of each of the clamping members 532 are designed to engage the ends of the ribs 546 which form part of guideway 548 such that clamping members 532 are normally biased such that curved outer surfaces 580 of clamping members 532 engage cord openings 544 of cover halves 522 and 524. In other words, when clamping members 532 are installed on cover halves 522 and 524, spring elements or arms 574 engage one of the ribs 546 of its respective cover halves 522 and 524 so as to preload spring elements or arms 574. This preload of spring elements or arms 574 also acts as retaining means to releasably couple or retain clamping member 532 with its respective cover half 522 or 524.

Flange portion 572 extends outwardly from body portion 570, and has a curved bearing surface 590 at its free end for tiltably engaging its respective bearing surface 552 of its respective cover half 522 or 524. In other words, when clamping members 532 are coupled to cover halves 522 and 524 respectively, curved bearing surfaces 590 engage bearing surfaces 552 of cover halves 522 and 524 to allow tilting movement of clamping members 532 within housing 520.

In its rest state, spring elements 574 are preloaded to hold clamping members 532 within cover halves 522 and 524 such that curved surface 580 of body portion 570 engages cord openings 544 and flange portion 572 engages the interior surface of each of the cover-halves 522 or 524 at second ends 542. In this manner, tilting surfaces 578 of each of the clamping members 532 form an angle relative to a longitudinal plane passing through the center of the electrical cord.

When housing halves 522 and 524 are partially closed, tilting surfaces 578 of clamping members 532 initially engage each other at an angle. Further, closure of housing halves 522 and 524 causes clamping members 532 to tilt about bearing surfaces 552 and 590 against the force of spring elements 574. This tilting movement of clamping members 532 causes electrical cord 512 to be engaged by ribs 577 which in turn axially pulls electrical cord 512 towards terminals 516 so as to provide strain relief between the end of electrical cord 512 and terminals 516. Clamping members 532 continue to tilt until tilting surfaces 578 of each of the clamping members 532 are tilted so that they are fully engaged with each other, i.e., parallel to each other and to a plane passing through the electrical cord 512.

While various embodiments have been chosen to illustrate the invention, it will be understood by those skilled in the art that various changes and modifications can be made herein without departing from the scope of the invention as defined in the appended claims.

What is claimed is:

1. An electrical wiring device adapted to be coupled to an end of an electrical cord with a plurality of electrical conductors, comprising:

a housing including first and second cover halves pivotally coupled together to form an electrical cord receiving cavity therebetween, and a contact retainer body with terminals coupled therein; and a cord clamp including a first clamping member tiltably coupled to said first cover half, and a second clamping member tiltably coupled to said second cover half, said first and second clamping members being positioned substantially opposite each other and arranged within said housing to automatically tilt upon engagement with the electrical cord in response to pivotal movement of said first cover half relative to said second cover half from an open position to a closed position to pull and secure the electrical cord within said electrical cord receiving cavity towards said terminals.

2. An electrical wiring device according to claim 1, wherein said first and second clamping members are tiltably coupled to said first and second cover halves by a snap-fit.

3. An electrical wiring device according to claim 1, wherein said first and second clamping members are arranged completely within said housing.

4. An electrical wiring device according to claim 1, wherein said first clamping member is biased by a first spring element about a first transverse axis to a tilted position such that said first clamping member is angled towards said second clamping member.

5. An electrical wiring device according to claim 4, wherein said second clamping member is biased by a second spring element about a second transverse axis to a tilted position such that said second clamping member is angled towards said first clamping member.

6. An electrical wiring device according to claim 5, wherein said first clamping member includes a pair of first spring elements, and said second clamping member includes a pair of second spring elements.

7. An electrical wiring device according to claim 6, wherein each of said first and second clamping members has a body portion with a cord recess, and a flange portion extending outwardly from said body portion.

8. An electrical wiring device according to claim 7, wherein each of said flange portions has a free end with a curved bearing surface for engaging a complementary curved bearing surface formed in said first and second cover halves, respectively.

9. An electrical wiring device according to claim 8, wherein each of said first spring elements has a fixed end coupled adjacent said body portion of said first clamping member and a free end for engaging said first cover half, and each of said second spring elements has a fixed end coupled adjacent said body portion of said second clamping member and a free end for engaging said second cover half.

10. An electrical wiring device according to claim 8, wherein each of said first spring elements has a fixed end coupled adjacent said free end of said flange portion of said first clamping member and a free end for engaging said first cover half; and each of said second spring elements has a fixed end coupled adjacent said free end of said flange portion of said second clamping member and a free end for engaging said second cover half.

11. An electrical wiring device according to claim 5, wherein said first and second spring elements are integrally formed with said first and second clamping members, respectively.

12. An electrical wiring device according to claim 11, wherein said first and second spring elements are leaf springs which engage portions of said first and second cover halves, respectively.

13. An electrical wiring device according to claim 1, wherein each of said first and second clamping members has a body portion with a cord recess, and a flange portion extending outwardly from said body portion.

14. An electrical wiring device according to claim 13, wherein said body portion of said first clamping member has a first pair of tilting surfaces, and said body portion of said second clamping member has a second pair of tilting surfaces for engaging said first pair of tilting surfaces to tilt said first and second clamping members about transverse axes relative to the electrical cord.

15. An electrical wiring device according to claim 14, wherein one of said first pair of tilting surfaces has an outwardly extending first tooth and the other of said first pair of tilting surfaces has a first notch, and one of said second pair of tilting surfaces has an outwardly extending second tooth for engaging said first notch of said first clamping member and the other of said second pair of tilting surfaces has a second notch for receiving said first tooth of said first clamping member therein.

16. An electrical wiring device according to claim 15, wherein said first and second clamping members are tiltably coupled to said first and second cover halves by a snap-fit.

17. An electrical wiring device according to claim 16, wherein each of said flange portions has a free end with a curved bearing surface for engaging a complementary curved bearing surface formed in said first and second cover halves, respectively.

18. An electrical wiring device according to claim 17, wherein said first cover half includes a first socket for receiving a part of said flange portion of said first clamping member, and said second cover half includes a second socket for receiving a part of said flange portion of said second clamping member.

19. An electrical wiring device according to claim 5, wherein said first spring element is integrally formed with said first cover half, and said second spring element is integrally formed with said second cover half.

20. An electrical wiring device according to claim 19, wherein said first and second clamping members are tiltably coupled to said first and second cover halves by a snap-fit.

21. An electrical wiring device according to claim 20, wherein said first spring element includes a first protrusion for engaging a first notch formed on said first clamping member, and said second spring element includes a second protrusion for engaging a second notch formed on said second clamping member.

22. An electrical wiring device adapted to be coupled to an end of an electrical cord with a plurality of electrical conductors, comprising:

a housing including first and second cover halves pivotally coupled together to form an electrical cord receiving cavity therebetween, and a contact retainer body with terminals coupled therein; and clamping means, tiltably coupled to said housing, for clamping the electrical cord to said housing, said clamping means being in a first inclined position when said housing cover halves are in an open position and being automatically tilted to a second position upon pivotal movement of said housing cover halves from said open position to a closed position such that said clamping means automatically engages the electrical cord to pull and secure the electrical cord within said electrical cord receiving cavity while said clamping means tilts from said first position to said second position.

23. An electrical wiring device according to claim 22, wherein said clamping means comprises first and second clamping members.

24. An electrical wiring device according to claim 22, wherein at least one of said first and second clamping members is an integral, one-piece element.

25. An electrical wiring device according to claim 24, wherein said first clamping member is tiltably coupled to said first cover half and said second clamping member is tiltably coupled to said second cover half, said first and second clamping members being positioned substantially opposite each other.

26. An electrical wiring device according to claim 25, wherein said first and second clamping members are tiltably coupled to said first and second cover halves by a snap-fit.

27. An electrical wiring device according to claim 25, wherein said first clamping member is biased by a first spring element about a first transverse axis to said first inclined position such that said first clamping member is angled towards said second clamping member.

28. An electrical wiring device according to claim 27, wherein said second clamping member is biased by a second spring element about a second transverse axis to the first inclined position such that said second clamping member is angled towards said first clamping member.

29. An electrical wiring device according to claim 28, wherein each of said first and second clamping members has a body portion with a cord recess, and a flange portion extending outwardly from said body portion.

30. An electrical wiring device according to claim 29, wherein each of said flange portions has a free end with a curved bearing surface for engaging a complementary curved bearing surface formed in said first and second cover halves, respectively, each of said first and second clamping members tilting about said curved bearing surface.

31. An electrical wiring device adapted to be coupled to an end of an electrical cord with a plurality of electrical conductors, comprising:

a housing including first and second cover halves pivotally coupled together to form an electrical cord receiving cavity therebetween, and a contact retainer body with terminals coupled therein, said first and second cover halves pivoting from an open position to a closed position; and a cord clamp including a first clamping member tiltably coupled to said first cover half and a second clamping member tiltably coupled to said second cover half, said first and second clamping members being positioned substantially opposite each other for automatically tiltably engaging the electrical cord upon installation thereon and closing of said housing to said closed position to pull the electrical cord within said electrical cord receiving cavity towards said terminals, said first clamping member being biased by a first spring element about a first transverse axis to a tilted position when said first and second cover halves are in said open position such that said first clamping member is angled towards said second clamping member.

32. An electrical wiring device according to claim 31, wherein said second clamping member is biased by a second spring element about a second transverse axis to a tilted position when said first and second halves are in said open position such that said second clamping member is angled towards said first clamping member.

33. An electrical wiring device according to claim 32, wherein said first clamping member includes a pair of first spring elements, and said second clamping member includes a pair of second spring elements.

34. An electrical wiring device according to claim 33, wherein each of said first and second clamping members has a body portion with a cord recess, and a flange portion extending outwardly from said body portion.

35. An electrical wiring device according to claim 34, wherein each of said flange portions has a free end with a curved bearing surface for engaging a complementary curved bearing surface formed in said first and second cover halves, respectively, each of said first and second clamping members tilting about said curved bearing surface.

36. An electrical wiring device according to claim 35, wherein each of said first spring elements has a fixed end coupled adjacent said body portion of said first clamping member and a free end for engaging said first cover half, and each of said second spring elements has a fixed end coupled adjacent said body portion of said second clamping member and a free end for engaging said second cover half.

* * * * *